US012303051B2

(12) United States Patent
Sutherland

(10) Patent No.: US 12,303,051 B2
(45) **Date of Patent: *May 20, 2025**

(54) ANTI-THEFT PACKAGE DELIVERY APPARATUS AND SYSTEM

(71) Applicant: 2571185 Alberta Ltd., Calgary (CA)

(72) Inventor: Cindy Sutherland, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/592,857

(22) Filed: Mar. 1, 2024

(65) Prior Publication Data

US 2025/0031890 A1 Jan. 30, 2025

Related U.S. Application Data

(63) Continuation of application No. 18/226,023, filed on Jul. 25, 2023, now Pat. No. 11,944,217.

(51) Int. Cl.
*A47G 29/20* (2006.01)

(52) U.S. Cl.
CPC ..... *A47G 29/20* (2013.01)

(58) Field of Classification Search
CPC .... A47G 29/20; A47G 29/124; A47G 29/141; A47G 2029/144; E05B 73/0005; E05B 73/0023; B65D 33/1616; B65D 33/28; B65D 55/14; B65D 2211/00
See application file for complete search history.

(56) References Cited

U.S. PATENT DOCUMENTS 209,233 A 10/1878 Cox
665,942 A 1/1901 Tabler
721,926 A 3/1903 Tyden
1,351,388 A 8/1920 Kabaci
4,785,960 A 11/1988 Belisle
5,346,311 A * 9/1994 Siler ..... B65D 33/30 383/33

(Continued)

FOREIGN PATENT DOCUMENTS

CA 2420981 3/2002

OTHER PUBLICATIONS

International Search Report And Written Opinion of the International Searching Authority for PCT/IB2024/000232 established by the ISA/CA completed on Oct. 4, 2024.

*Primary Examiner* — William L Miller
(74) *Attorney, Agent, or Firm* — Goldstein Law Offices, P.C.

(57) ABSTRACT

A package delivery apparatus for securing delivered packages includes a flexible bag, a security strap, and a locking mechanism. The flexible bag is configured to accommodate one or more packages and includes an opening adjustable between an open position and a closed position. The security strap is integrated with the bag and cinches around the opening. The locking mechanism selectively allows the security strap to move in one direction to secure the closed position. The locking mechanism includes a housing, a lock element, a ratcheting mechanism, and a handle mechanism. The security strap extends through the housing and the ratcheting mechanism and is coupled to the handle mechanism. Moving the handle mechanism to an extended position cinches and locks the bag closed. The lock element is selectively actuated to disengage the security strap from the ratcheting mechanism and allow the bag to be re-opened.

20 Claims, 21 Drawing Sheets

(56) References Cited

U.S. PATENT DOCUMENTS

| | | | | |
|---|---|---|---|---|
| 8,179,267 | B2 | 5/2012 | Anderson et al. | |
| 9,926,108 | B2 | 3/2018 | Wiley et al. | |
| 10,143,320 | B1 | 12/2018 | Batts | |
| 10,180,016 | B2 | 1/2019 | Critz | |
| 10,282,951 | B1 | 5/2019 | Kulick | |
| 10,537,197 | B2 | 1/2020 | Hopp | |
| 10,653,261 | B2 | 5/2020 | Loures et al. | |
| 11,197,567 | B2 | 12/2021 | Lemiuex | |
| 11,330,927 | B2 | 5/2022 | Loures et al. | |
| 11,406,212 | B2 * | 8/2022 | Odeh | A47G 29/141 |
| 11,412,876 | B1 | 8/2022 | Kadlub et al. | |
| 12,133,604 | B2 * | 11/2024 | Courtney | A47G 29/141 |
| 2008/0072633 | A1 | 3/2008 | Samuel | |
| 2012/0269461 | A1 | 10/2012 | Proctor et al. | |
| 2013/0077896 | A1 | 3/2013 | Wiley et al. | |
| 2018/0162612 | A1 | 6/2018 | Bojic | |
| 2018/0202199 | A1 | 7/2018 | Critz | |
| 2019/0038062 | A1 | 2/2019 | Sundaresan | |
| 2019/0104876 | A1 | 4/2019 | Loures et al. | |
| 2019/0133362 | A1 | 5/2019 | Gilligan | |
| 2019/0269268 | A1 | 9/2019 | Blubaugh | |
| 2020/0015617 | A1 | 1/2020 | Izquierdo Gonzalez | |
| 2020/0060460 | A1 | 2/2020 | Farrar et al. | |
| 2020/0388095 | A1 | 12/2020 | Agbeyo | |
| 2021/0045563 | A1 | 2/2021 | Bartley-Clark | |
| 2022/0183491 | A1 * | 6/2022 | Cooper | A47G 29/20 |
| 2023/0124995 | A1 | 4/2023 | Yu | |
| 2023/0157472 | A1 | 5/2023 | Barkman et al. | |
| 2023/0322456 | A1 * | 10/2023 | Parks | B65D 55/14<br>220/210 |
| 2024/0197097 | A1 * | 6/2024 | Gregory | A47G 29/141 |

* cited by examiner

ANTI-THEFT PACKAGE DELIVERY APPARATUS AND SYSTEM

CROSS REFERENCES AND RELATED SUBJECT MATTER

This application is a continuation of patent application Ser. No. 18/226,023, filed in the United States Patent Office on Jul. 25, 2023, which is incorporated by reference in its entirety herein and from which priority is claimed.

TECHNICAL FIELD

The present disclosure relates generally to package delivery systems. More particularly, the present disclosure relates to a package delivery system that enhances security of unattended packages.

BACKGROUND

With the rapid growth of e-commerce and online shopping, the demand for efficient and secure package delivery solutions has significantly increased. The convenience of doorstep package deliveries, however, has led to an unfortunate rise in theft and package tampering incidents. Opportunistic individuals often seize the opportunity to steal packages left unattended on doorsteps or in common areas, causing financial loss and inconvenience for both customers and delivery companies.

Various attempts have been made to address the issue of package theft following package delivery. Lockboxes and secure storage compartments are often implemented to curtail some of these problems. Other solutions involve requiring recipients to be present for delivery. While these approaches offer some level of security, they may be impractical for customers who are not available at the time of delivery or cost-prohibitive for customers who do not have lockboxes or storage compartments readily available.

Other solutions utilize tamper-evident packaging, GPS tracking systems, or video surveillance systems to deter theft and improve traceability. Although these approaches have proven effective to some extent, they often do not provide a physical barrier to prevent unauthorized access to package contents. In addition, these solutions tend to be costly, complex, and often incompatible with existing delivery networks.

Therefore, what is needed is a cost-effective, easy-to-use package delivery system that combines the convenience of doorstep deliveries with enhanced security measures to minimize the risk of theft or tampering. Beneficially, such a package delivery system would be durable, reusable, and compatible with various customers and delivery company operations.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

One aspect of the present disclosure provides a package delivery apparatus for securing delivered packages. In certain embodiments, the package delivery apparatus includes a flexible bag configured to accommodate one or more packages, a security strap, and a locking mechanism. The flexible bag includes an interior area, an exterior surface, and a top edge forming an opening. The opening is adjustable between an open position providing access to the interior area and a closed position preventing access thereto.

The security strap is integrated with the flexible bag and is configured to cinch around the opening to move the opening to the closed position. The locking mechanism moves the security strap in exactly one direction to secure the closed position.

The locking mechanism is coupled to the flexible bag and configured to selectively allow the security strap to move in one direction to secure the opening in the closed position. The locking mechanism includes a housing, a lock element, a ratcheting mechanism, and a handle mechanism. The housing has an interior surface, an exterior surface, and at least one slot extending therethrough. The slot is configured to receive at least a portion of the security strap.

The lock element is accessible on the exterior surface of the housing and configured to rotate within the housing to release a position of the security strap. The ratcheting mechanism is fixed to the interior surface of the housing and configured to selectively engage the portion of the security strap to only allow the security strap to move in the one direction. The handle mechanism is coupled to the portion of the security strap and extends from the housing. The handle mechanism is movable from a retracted position to an extended position to cinch the security strap and move the opening to the closed position.

In some embodiments, the locking mechanism includes one or more guide elements coupled to the interior surface of the housing to guide the portion of the security strap through the one or more slots and into the ratcheting mechanism.

In some embodiments, the housing includes a first sidewall having a first slot and a second sidewall having a second slot. The security strap extends through each of the first slot and the second slot to form a closed loop within the housing. In some embodiments, the handle mechanism is coupled to the closed loop such that moving the handle mechanism to the extended position moves the security strap through the first and second slots simultaneously. In certain embodiments, the housing includes an aperture to receive the handle mechanism therethrough.

In some embodiments, the apparatus includes a key element configured to engage the lock element to selectively actuate a release mechanism. The release mechanism is coupled to the interior surface of the housing and configured to selectively disengage the portion of the security strap from the ratcheting mechanism. In certain embodiments, a linkage element is coupled to the ratcheting mechanism. The key element is configured to selectively engage the linkage element to actuate the release mechanism.

In some embodiments, the ratcheting mechanism includes at least one pawl and the release mechanism is configured to rotate the pawl to release the security strap. In some embodiments, the security strap includes a ratcheting cable, a perforated belt, or a toothed belt. The ratcheting mechanism includes at least one pawl configured to engage the security strap. In other embodiments, the ratcheting mechanism includes a pulley configured to engage at least one pawl to secure a position of the security strap.

According to another aspect of the present disclosure, a package delivery system for securing delivered packages includes a flexible bag, a security strap, a rigid receptacle, and a locking mechanism. The flexible bag includes an interior area, an exterior surface, a top end, a bottom end, and a top edge forming an opening. The opening is adjustable between an open position providing access to the interior area and a closed position preventing access to the interior area. The interior area is configured to accommodate at least one package.

The security strap is integrated with the top end of the flexible bag and configured to cinch around the opening to move the opening to the closed position. The rigid receptacle includes a longitudinal axis, a receiving end having an outer perimeter, and at least one side extending downward from the outer perimeter in a direction parallel to the longitudinal axis. The rigid receptacle is configured to removably retain the flexible bag such that the flexible bag extends along the longitudinal axis from the top end to the bottom end within the rigid receptacle.

The locking mechanism is coupled to the receiving end and configured to selectively allow the security strap to move in one direction to secure the opening in the closed position. The locking mechanism includes a housing, a lock element, a ratcheting mechanism, and a handle mechanism. The housing includes an interior surface, an exterior surface, and a slot extending therethrough. The slot is configured to receive at least a portion of the security strap.

The lock element is accessible on the exterior surface of the housing and configured to rotate within the housing to release a position of the security strap. The ratcheting mechanism is fixed to the interior surface and configured to selectively engage the portion of the security strap to only allow the security strap to move in the one direction. The handle mechanism is coupled to the portion of the security strap and extends from the housing. The handle mechanism is movable from a retracted position to an extended position to cinch the security strap and thereby move the opening to the closed position.

In some embodiments, an anchor element is coupled to the rigid receptacle and configured to anchor the rigid receptacle to a fixed structure. In some embodiments, the anchor element includes a cable having a first end integrated with the locking mechanism and a second end secured to the fixed structure. In certain embodiments, the locking mechanism is configured to selectively release the anchor element from the rigid receptacle.

In some embodiments, the top edge of the flexible bag is configured to fold over the outer perimeter to engage the rigid receptacle when the opening is in the open position. The top edge is thus disposed below the receiving end in the open position. In some embodiments, the top edge of the flexible bag is configured to move upward in a direction parallel to the longitudinal axis to disengage the top edge from the rigid receptacle and create a lid when the handle mechanism is moved towards the extended position.

In some embodiments, the rigid receptacle includes one or more securing features configured to engage the exterior surface of the flexible bag. In some embodiments, at least one attachment element is coupled to the exterior surface of the flexible bag and configured to engage the one or more securing features.

In some embodiments, the package delivery system includes a key element configured to engage the lock element to selectively actuate a release mechanism. The release mechanism is coupled to the interior surface of the housing and configured to selectively disengage the security strap from the ratcheting mechanism. In certain embodiments, the release mechanism is further configured to release the anchor element from the rigid receptacle.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

As discussed above, the convenience of doorstep package deliveries has led to an unfortunate rise in theft and package tampering incidents. While various attempts have been made to address this issue, such solutions tend to be impractical and/or expensive to implement. For example, video surveillance systems, GPS tracking systems, and other electronic solutions tend to be costly, complex, and often incompatible with existing delivery networks. The embodiments disclosed herein address these and other issues.

Figure 1:
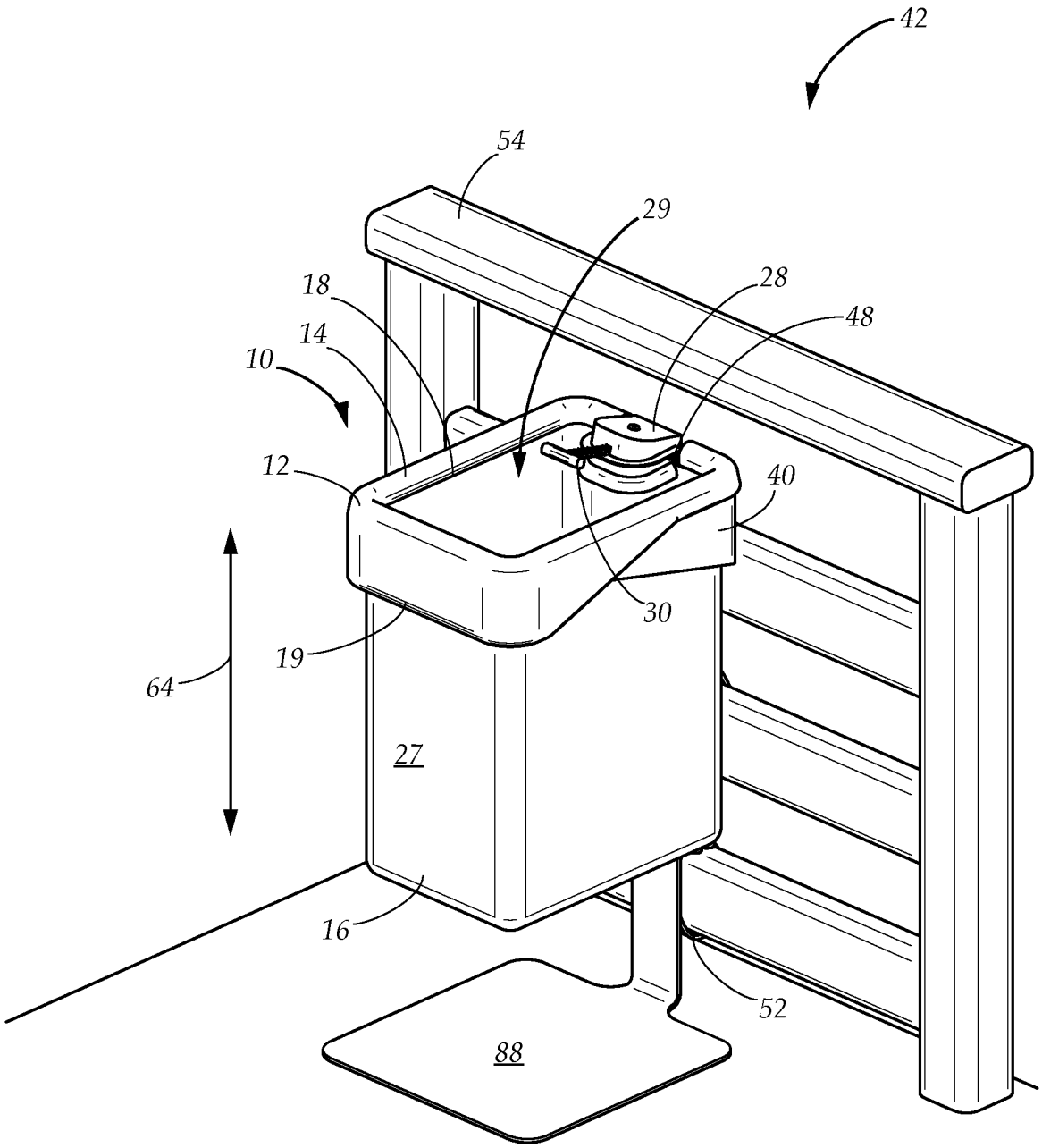
FIG. 1 is a perspective view of a representative package delivery system in accordance with some embodiments of the disclosure.

Referring now to FIG. 1, a package delivery system 42 for securing delivered packages includes a package delivery apparatus 10 anchored to a fixed structure 54 such as a railing, a wall, a ground anchor, a cement block, or building, or the like. The package delivery apparatus 10 may include a flexible bag 12 having an exterior surface 27, a bottom end 16, a top end 14, and an interior area 29. In some embodiments, the flexible bag 12 extends from the top end 14 to the bottom end 16 along a longitudinal axis 64. In some embodiments, the flexible bag 12 includes an oblong or elongate shape. For example, in some embodiments, the flexible bag 12 has a cylindrical, rectangular, elliptical, or other suitable regular or irregular shape. In some embodiments, the shape of the flexible bag 12 forms the shape of the internal area 29.

The flexible bag 12 may be cut-resistant and/or may include a strong, durable material, textile or fabric such as canvas, burlap, polyethylene, polyester, nylon, or any other suitable material or combination thereof. Some embodiments of the flexible bag 12 include a wire mesh fabric and/or a ballistic-grade fabric. In some embodiments, the exterior surface 27 and/or the interior area 29 of the flexible bag 12 includes a water-resistant and/or structural reinforcement coating, additive, laminate, varnish, or the like.

Figure 5A:
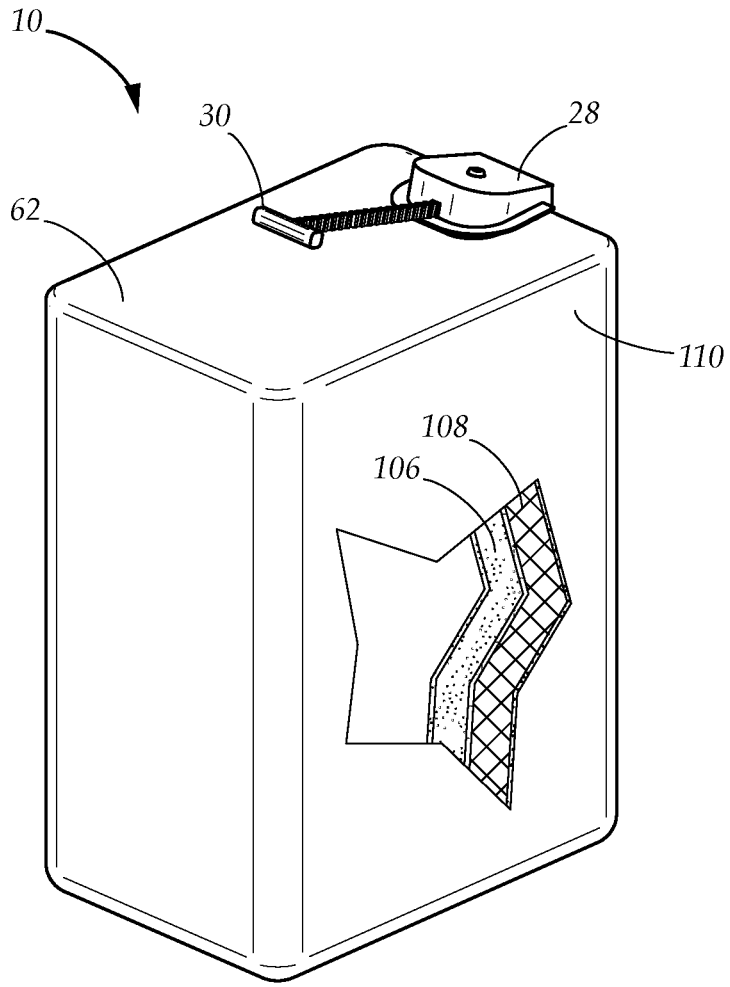
FIG. 5A is a cross-sectional view of a representative package delivery apparatus illustrating the flexible bag within the rigid receptacle in accordance with some embodiments.
Figure 5B:
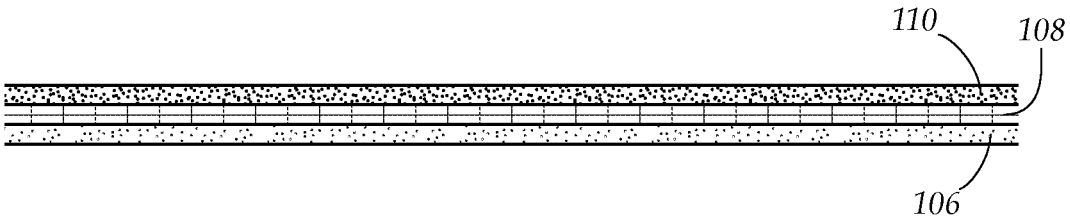
FIG. 5B is an enlarged cross-sectional view of various layers of the package delivery apparatus of FIG. 5A.
Figure 6:
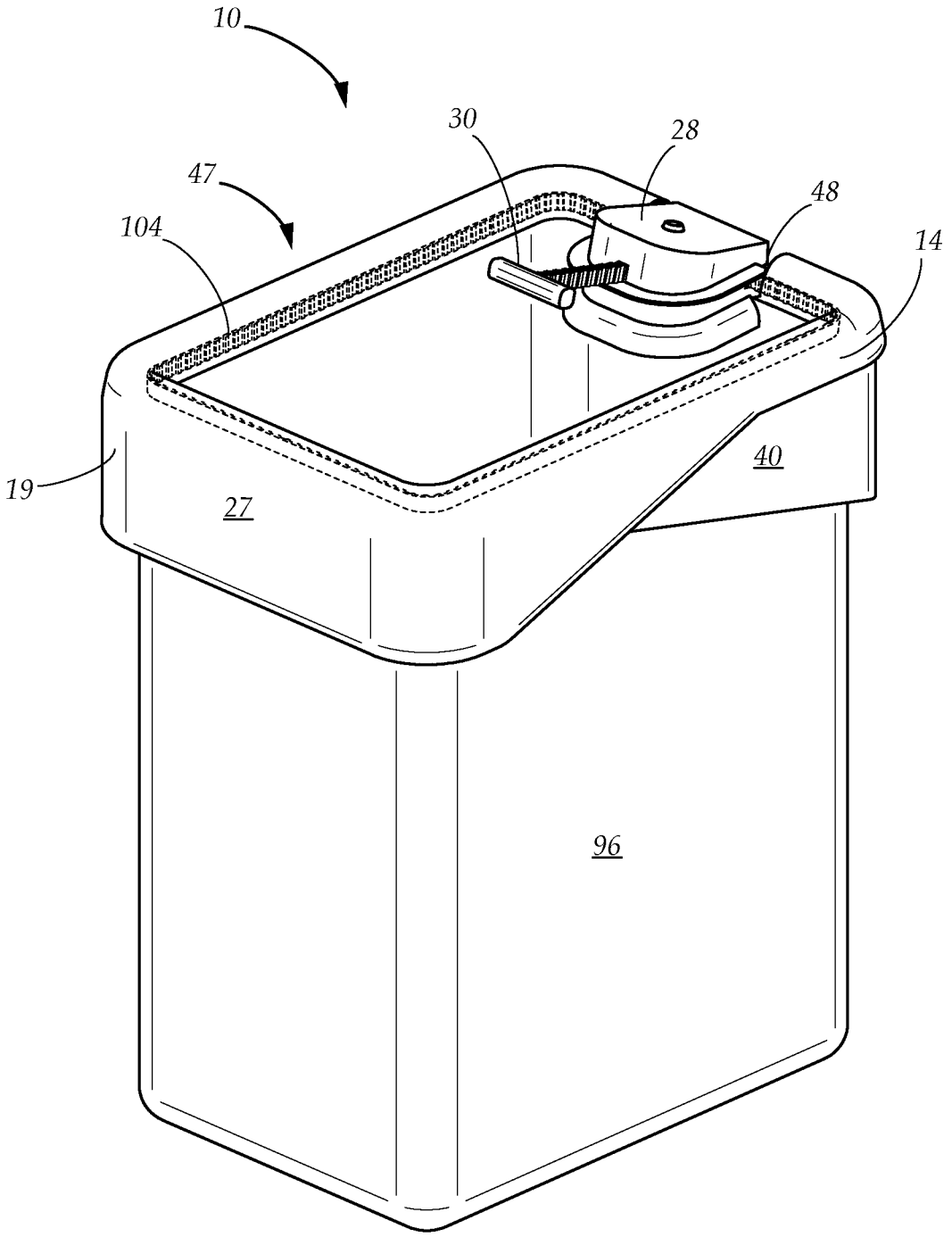
FIG. 6 is a perspective view of one embodiment of a package delivery apparatus depicting implementation of the security strap in accordance with the disclosure.
Figure 7:
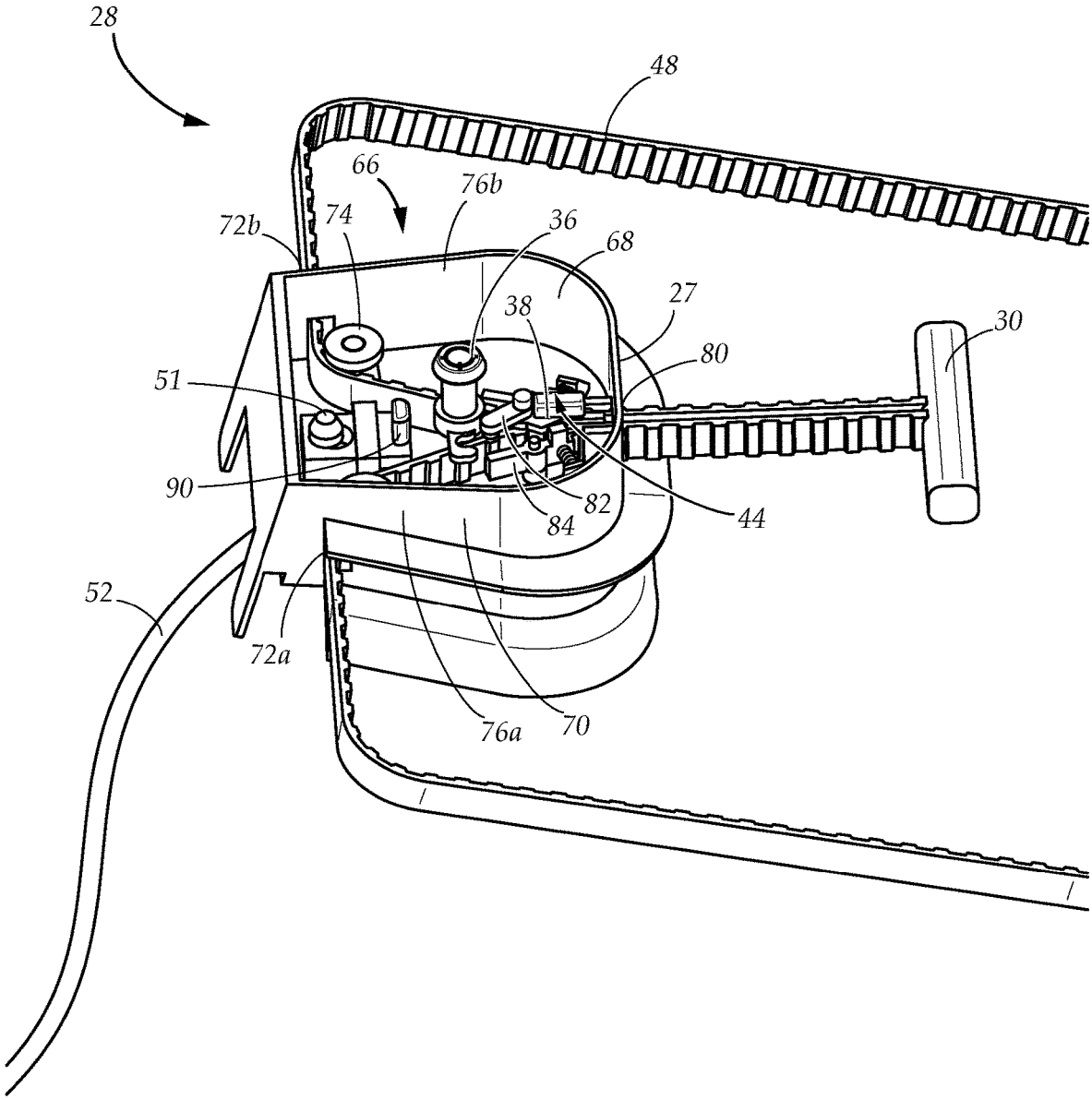
FIG. 7 is a perspective view of one embodiment of a locking mechanism and an anchor element in accordance with the disclosure.

In some embodiments, the exterior surface 27 and/or the flexible bag 12 may include more than one layer. As illustrated in FIGS. 5A and 5B, while still referring to FIG. 1, in one embodiment, the flexible bag 12 includes a trilaminate material having a first layer 106, a second layer 108, and a third layer 110. In some embodiments, the first layer 106 includes an abrasion-resistant material such as nylon and/or another suitable material. The second layer 108 may include a waterproof membrane and/or cut-resistant layer such as butyl rubber, wire mesh, and/or the like. The third layer 110 may include a weather-resistant material such as canvas, nylon, and/or another suitable material. In some embodiments, any of the first, second and/or third layers 106, 108, 110 may include a coating such as a polyurethane film or other suitable coating to increase durability, weather-resistance, and/or structural integrity. In some embodiments, the exterior surface 27, interior area 29, bottom end 16, and/or other portions of the flexible bag 12 may include additional layers and/or elements to provide reinforcement to the flexible bag 12 and/or to increase its structural integrity.

Figure 2A:
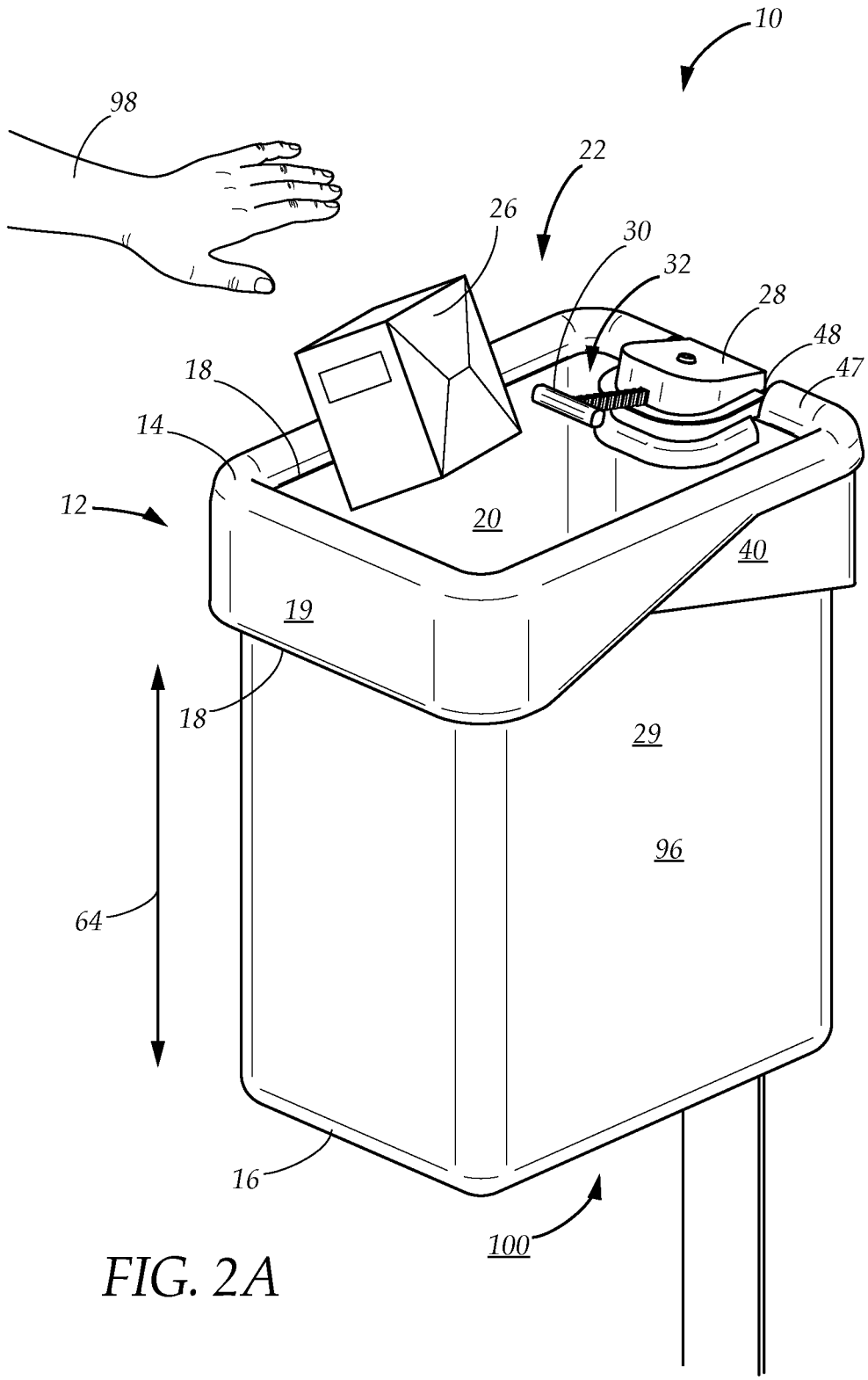
FIG. 2A is a perspective view of a representative package delivery apparatus in an open position during package delivery in accordance with some embodiments.
Figure 2B:
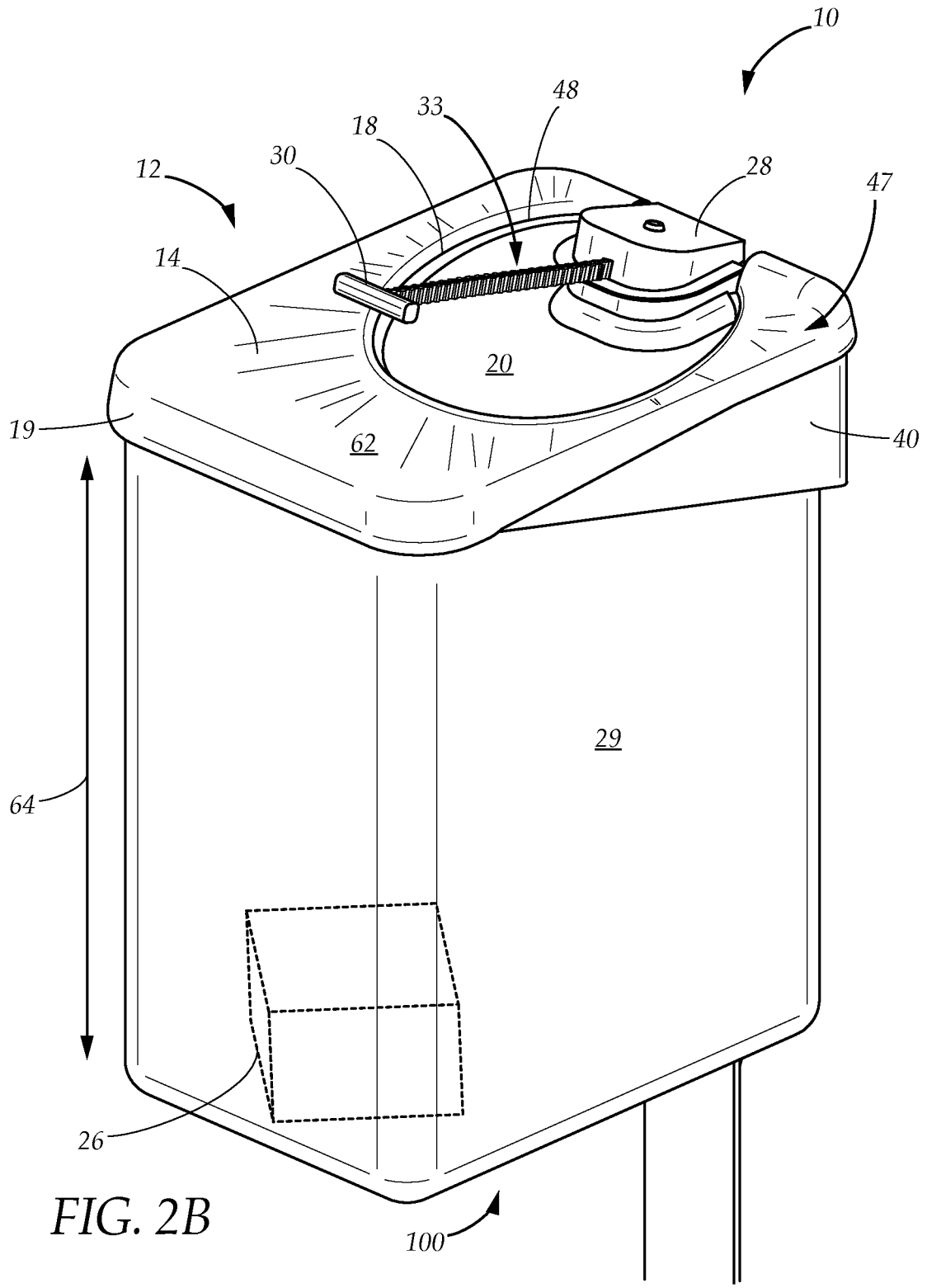
FIG. 2B is a perspective view of the representative package delivery apparatus of FIG. 2A in an intermediate position following package delivery in accordance with certain embodiments.
Figure 2C:
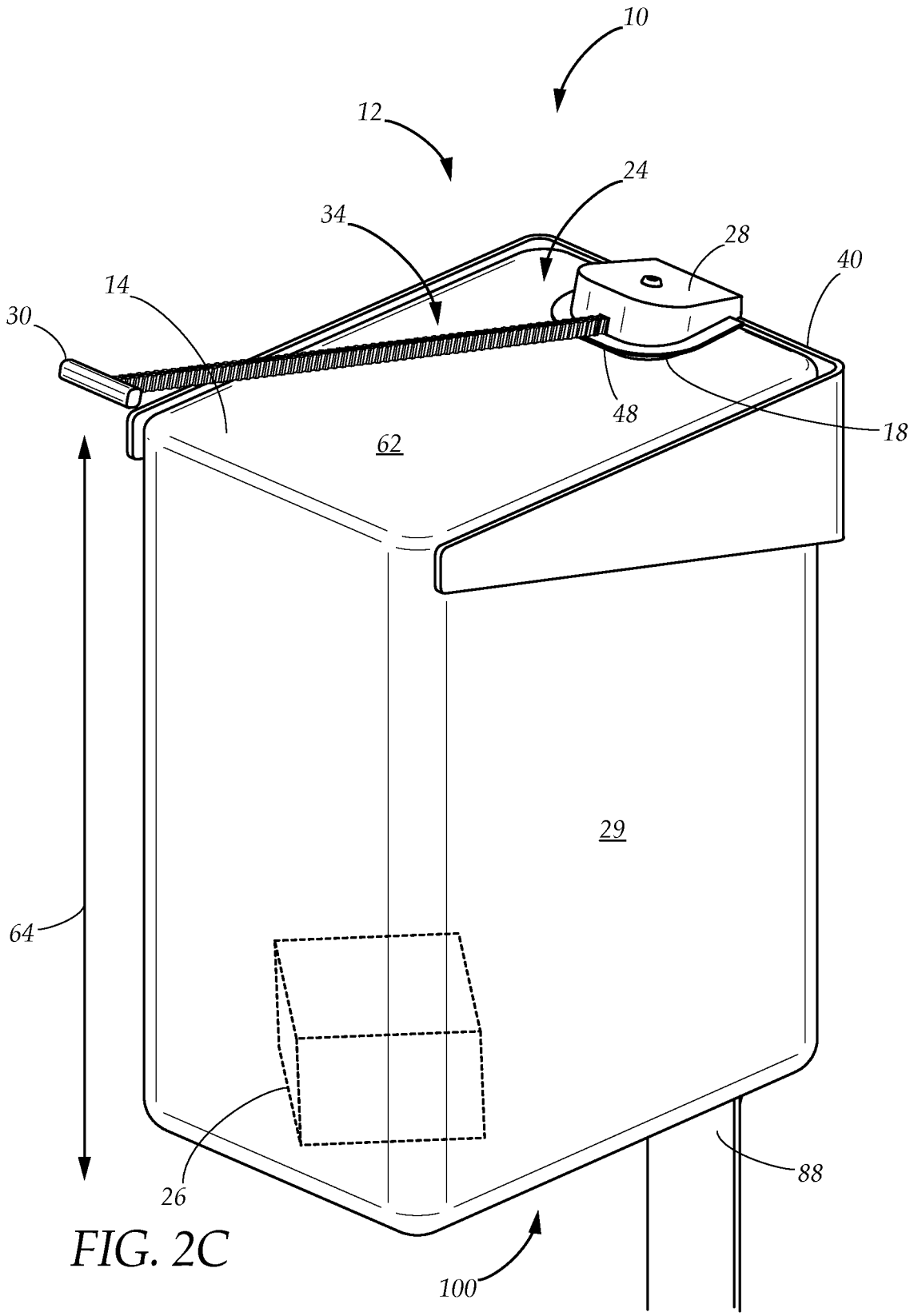
FIG. 2C is a perspective view of the representative package delivery apparatus of FIG. 2A in a closed and locked position following package delivery in accordance with some embodiments.

Referring now to FIGS. 2A, 2B, and 2C, while still referring to FIG. 1, the top end 14 may include a top edge 18 forming an opening 20. In some embodiments, the opening 20 is disposed opposite the bottom end 16. The opening 20 may provide selective access to the interior area 29. In some embodiments, the interior area 29 of the flexible bag 12 is configured to support the contents of the flexible bag 12, including one or more packages 26. Thus, in certain embodiments, the opening 20 includes dimensions configured to receive at least one package 26 and the interior area 29 includes a size, shape, and dimensions sufficient to accommodate the package 26 or packages 26.

In some embodiments, the opening 20 is adjustable between an open position 22 that provides access to the interior area 29 and a closed position 24 that prevents access to the interior area 29. For example, in some embodiments, the top end 14 of the flexible bag 12 is coupled to or integrated with a security strap 48. The security strap 48 may be configured to cinch around the opening 20 to move the opening to the closed position 24.

In some embodiments, the security strap 48 is an elongate strap that is substantially flexible or resilient. For example, the security strap 48 may include a strap or cable made of metal wire, steel, polyvinyl chloride ("PVC"), polypropylene ("PP"), polyester ("PET"), and/or any other suitable material or combination of materials. In some embodiments, the security strap 48 is cut-resistant. In some embodiments, the security strap 48 includes a ratcheting cable, a perforated belt, or a toothed belt.

The security strap 48 may be configured to cinch the top end 14 of the flexible bag 12 to move the opening 20 from the open position 22 to the closed position 24. In some embodiments, the security strap 48 is coupled to or integrated with a locking mechanism 28 to selectively secure or lock the opening 20 in the closed position 24. In certain embodiments, a handle mechanism 30 is coupled to or integrated with the locking mechanism 28 to facilitate actuating the security strap 48 to secure the opening 20 in the closed position 24.

Figure 4A:
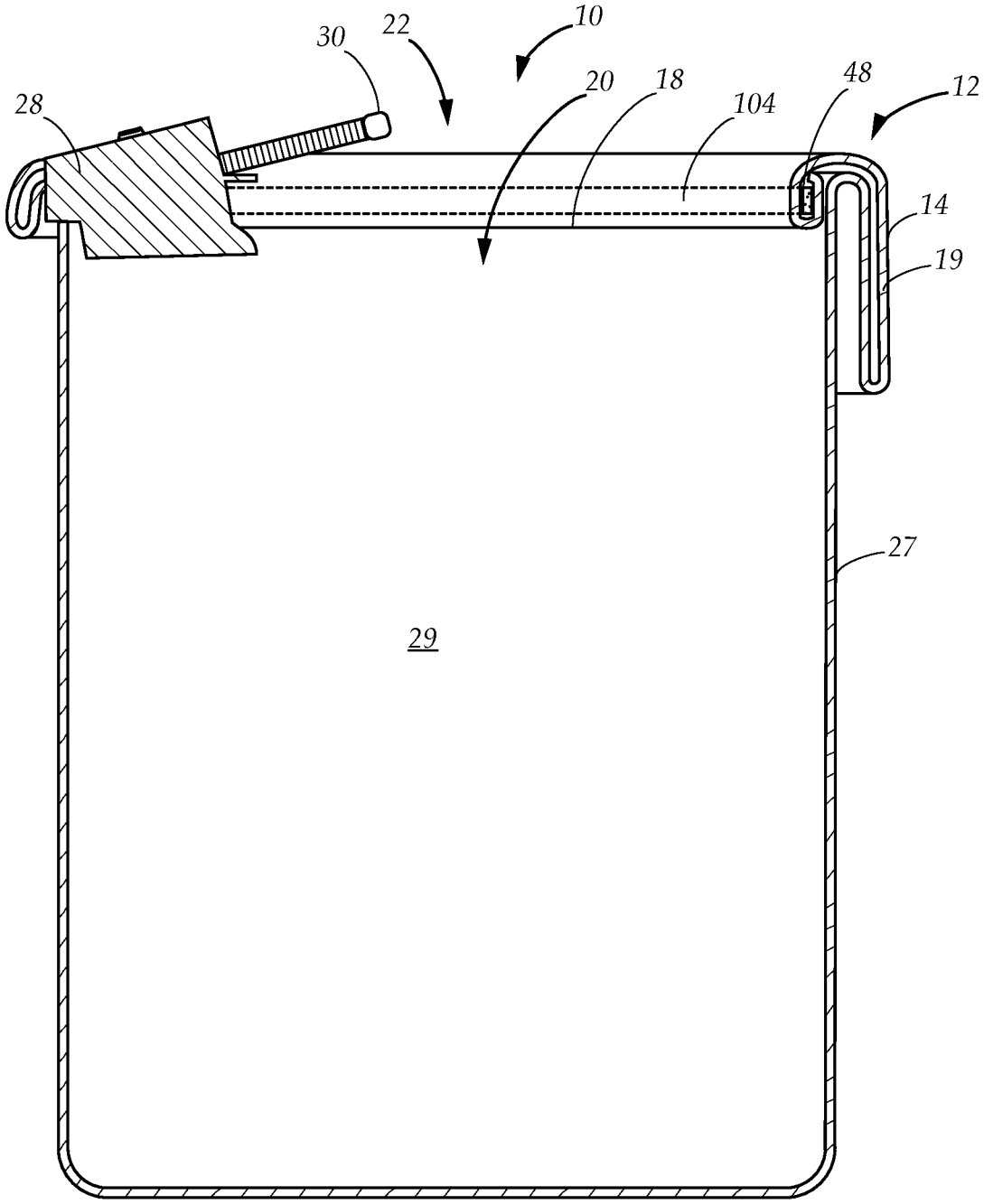
FIG. 4A is a cross-sectional view of one embodiment of a package delivery apparatus illustrating the handle mechanism in a retracted position in accordance with the disclosure.
Figure 4B:
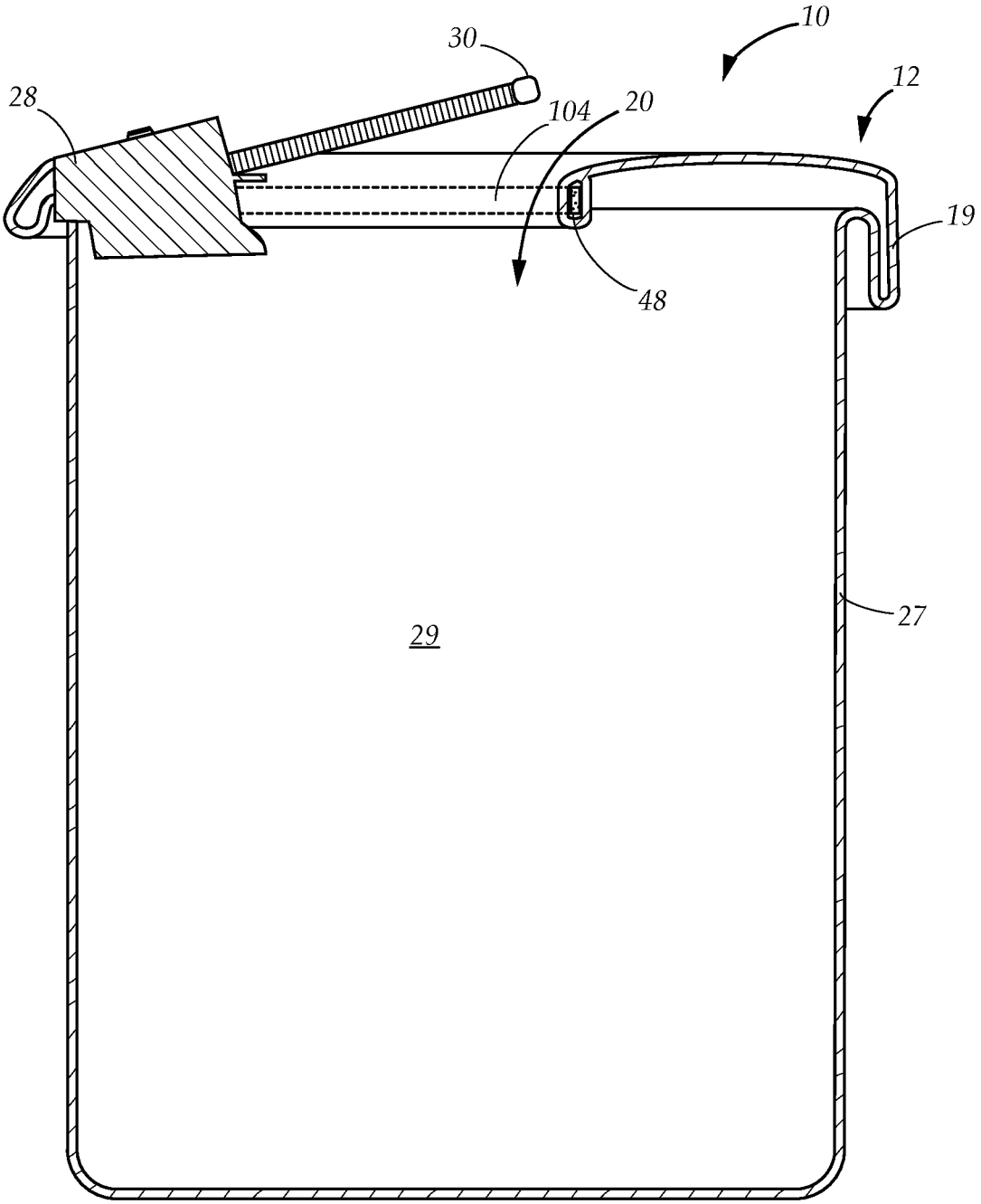
FIG. 4B is a cross-sectional view of the package delivery apparatus of FIG. 4A illustrating the handle mechanism in a partially extended position in accordance with some embodiments.
Figure 4C:
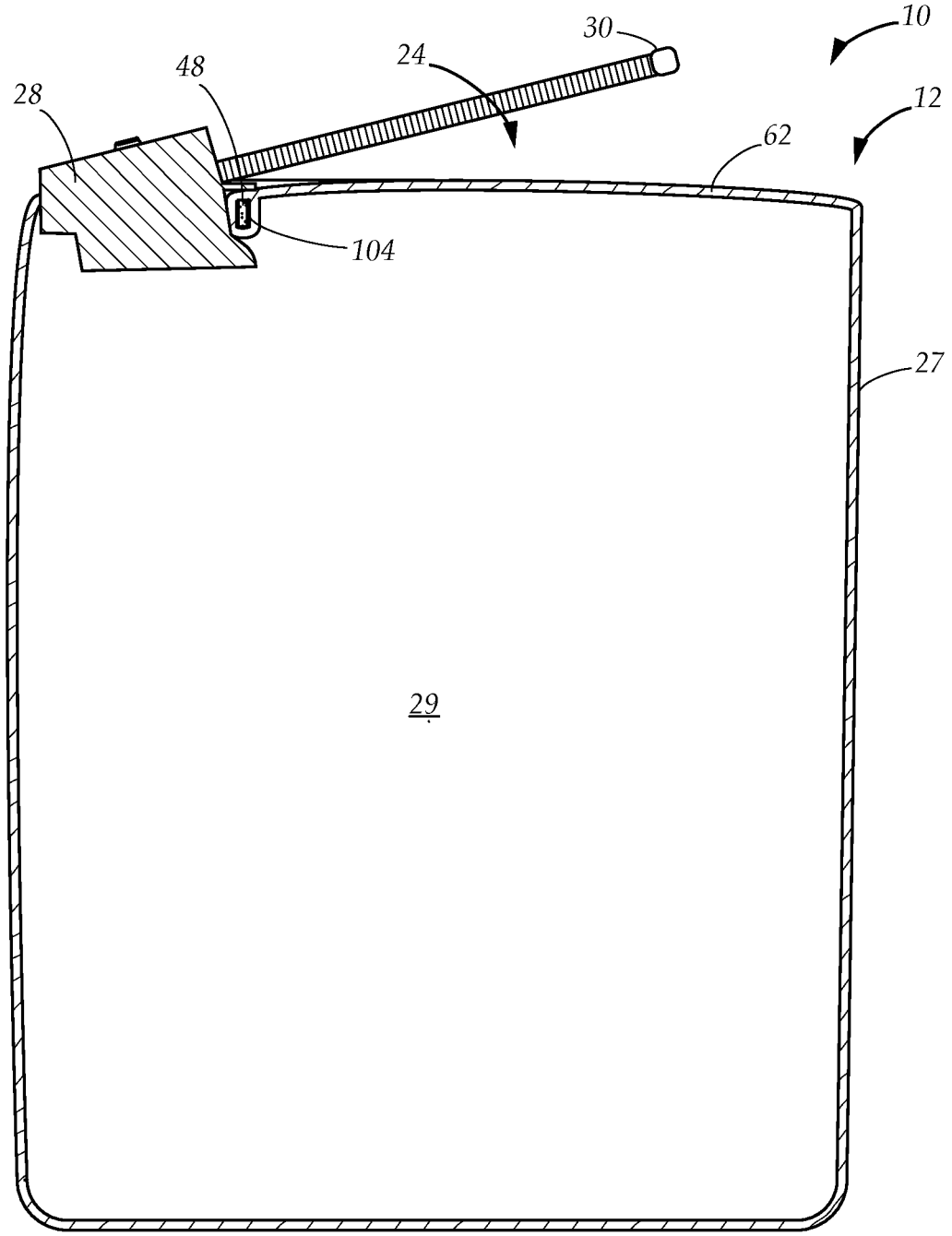
FIG. 4C is a cross-sectional view of the package delivery apparatus of FIG. 4A illustrating the handle mechanism in a fully extended position in accordance with some embodiments.

In certain embodiments, the security strap 48 is permanently affixed to the flexible bag 12. In these and other embodiments, the security strap 48 may be movable with respect to the flexible bag 12. For example, in one embodiment, as shown in FIGS. 4A, 4B, and 4C, at least a portion of the security strap 48 may be retained within a channel 104 that is sewn or otherwise integrated into the flexible bag 12. In some embodiments, the channel 104 is integrated along or adjacent to the top edge 18. The channel 104 may include dimensions at least slightly greater than dimensions of the security strap 48 such that the security strap 48 may be accommodated therein and permitted to cinch. In some embodiments, the channel 104 includes dimensions selected to prevent the security strap 48 from twisting inside the channel 104.

Figure 3A:
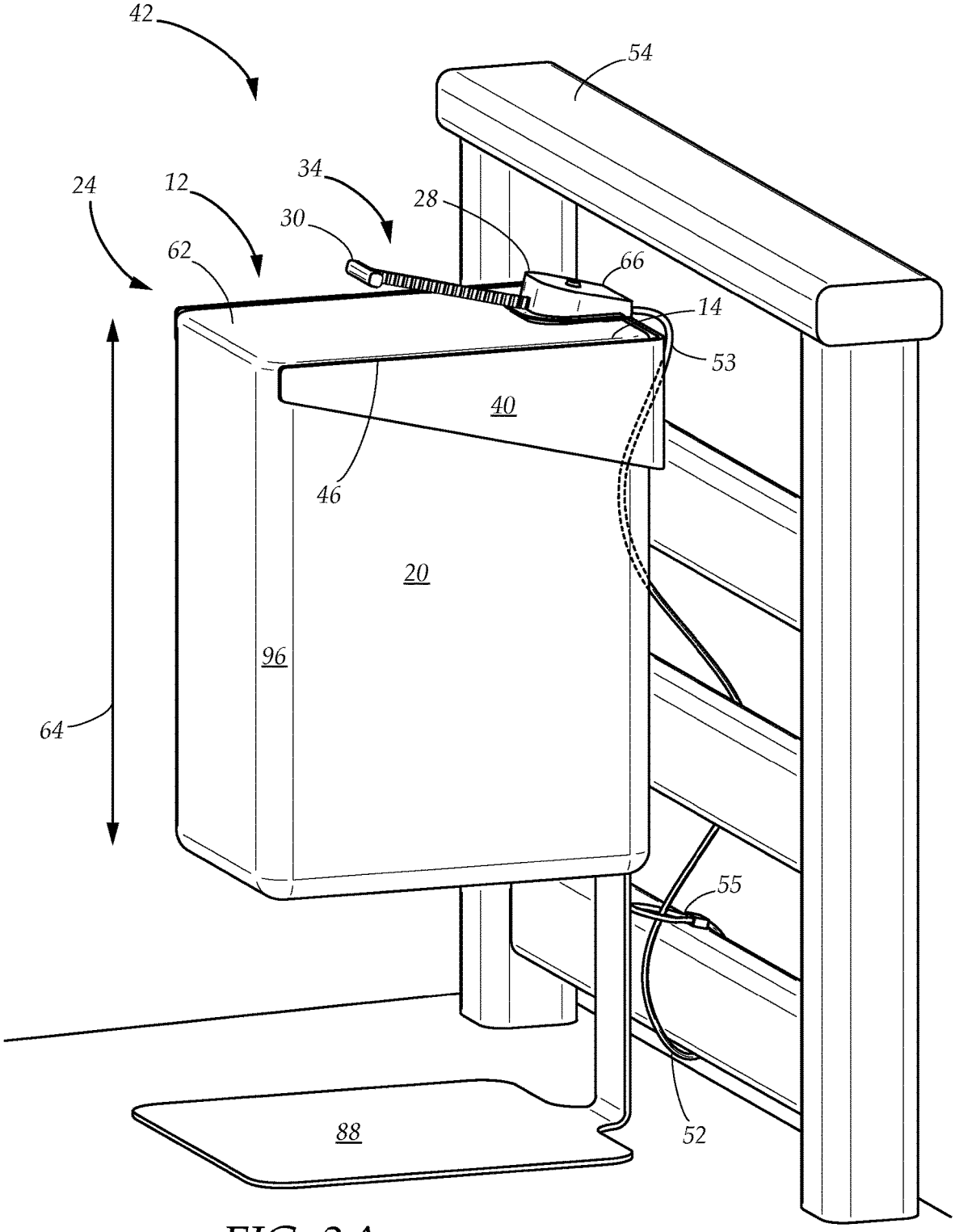
FIG. 3A is a side perspective view of one embodiment of a package delivery system attached to a fixed railing in accordance with the disclosure.
Figure 3B:
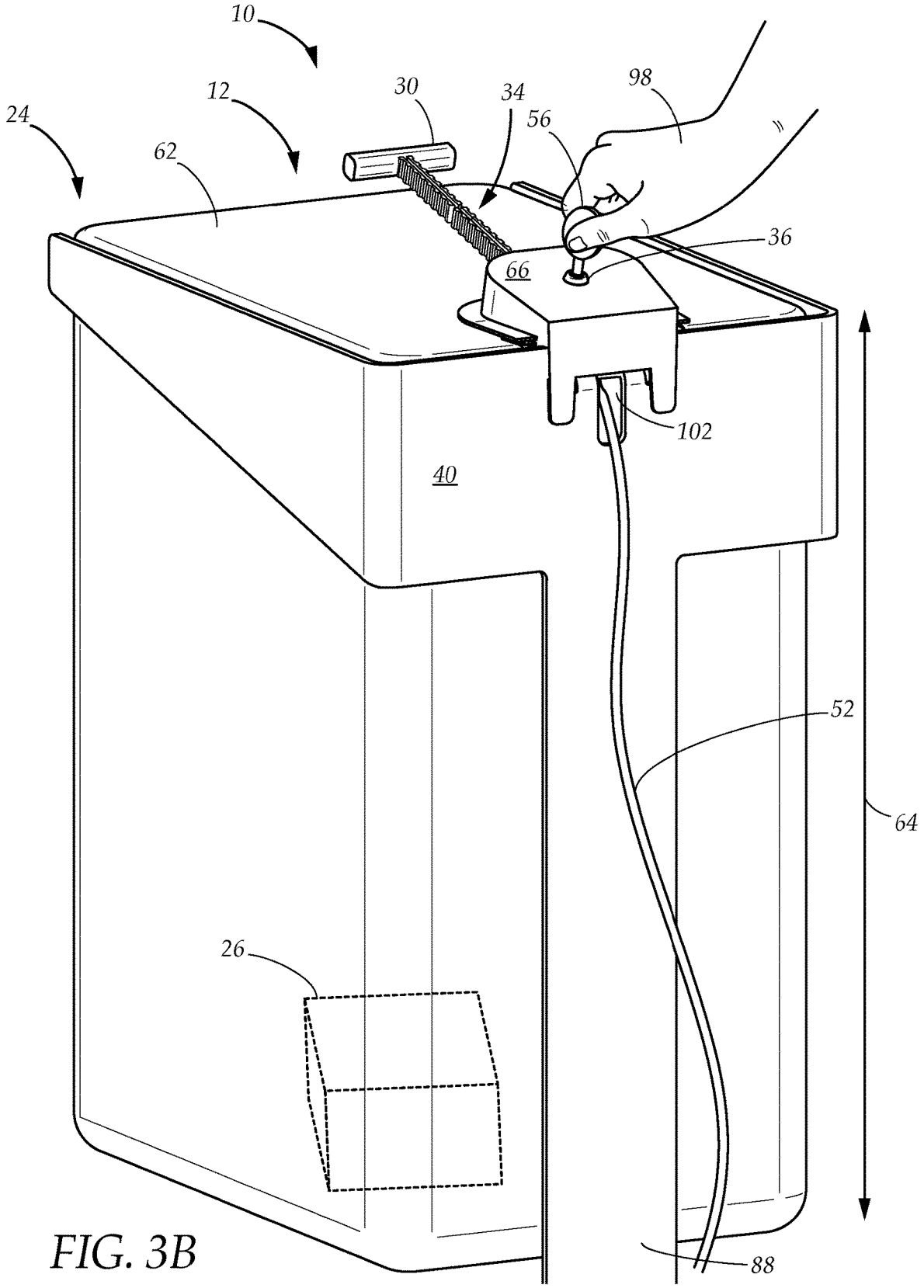
FIG. 3B is a rear perspective view of the package delivery system of FIG. 3A in accordance with some embodiments.
Figure 3C:
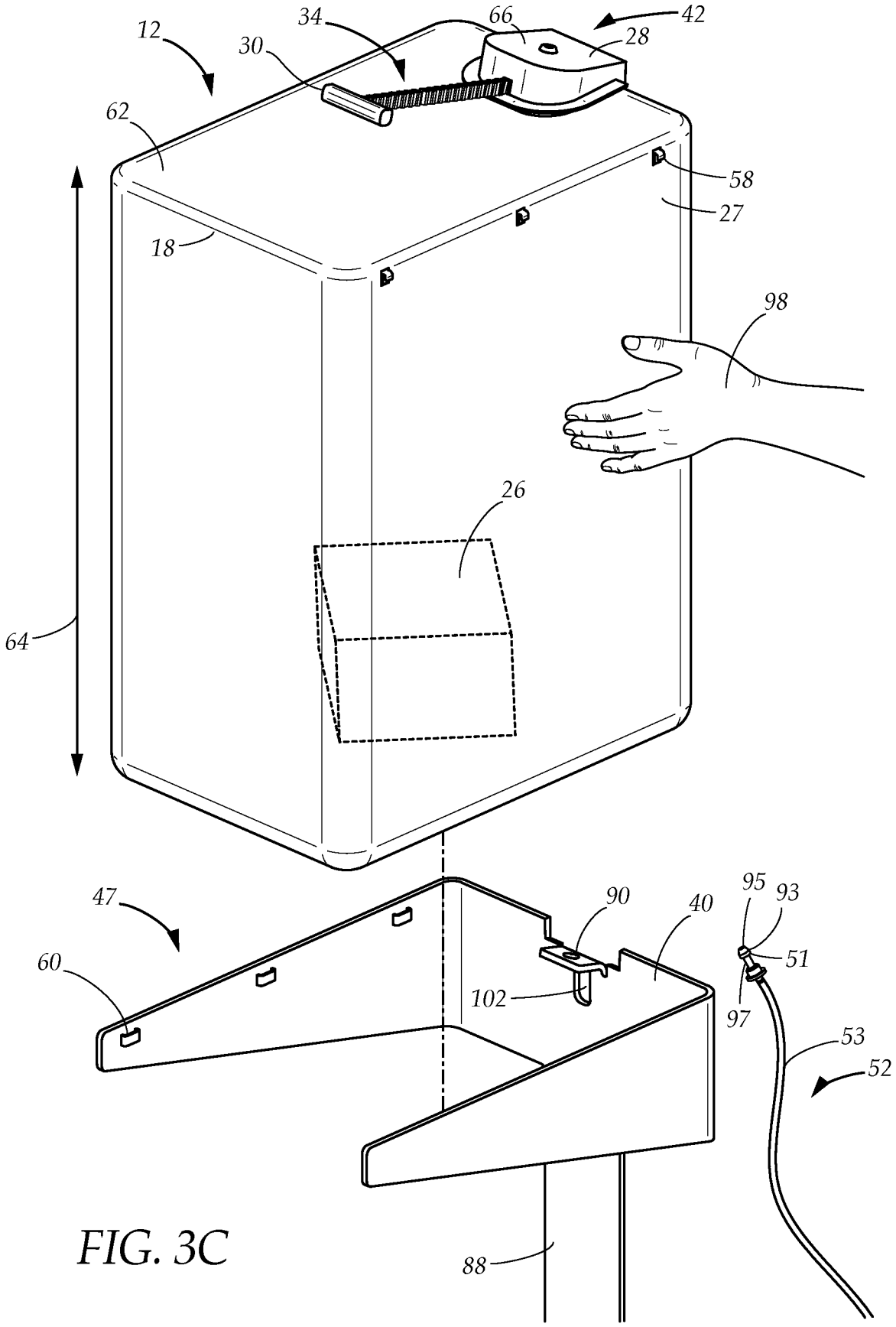
FIG. 3C is an exploded view of the package delivery system of FIG. 3A.

In the open position 22 illustrated in FIG. 4A, while also referring to FIG. 3C, the channel 104 may be substantially aligned with the outer perimeter 47 of the rigid receptacle 40 such that the top end 14 of the flexible bag 12 overhangs the rigid receptacle 40 such that the exterior surface 27 of the flexible bag 12 is layered on top of itself and the dimensions of the opening 20 are maximized. Cinching the security strap 48 may simultaneously cinch the top edge 18 of the flexible bag 12, thereby progressively reducing the size of the overhang 19 and the size of opening 20 until it reaches the closed position 24 illustrated in FIG. 4C.

In other embodiments, the top end 14 of the flexible bag 12 includes a plurality of holes or openings such that at least a portion of the security strap 48 may be woven therethrough. Drawing the security strap 48 through the openings may cinch the top end 14 until the opening 20 reaches the closed position 24 illustrated in FIG. 4C. In these and other embodiments, actuating the security strap 48 to close the opening 20 automatically locks the opening 20 in an intermediate 33 or closed position 24.

Referring now to FIGS. 3A, 3B, and 3C, in some embodiments, the package delivery system 42 further includes a rigid receptacle 40. In some embodiments, the rigid receptacle 40 is made of steel, aluminum, a metal alloy, PVC, wood, another suitable natural or synthetic rigid material, and/or combination thereof. In some embodiments, the rigid receptacle 40 extends along the longitudinal axis 64 between a stabilizing end 88 and a receiving end 46. In some embodiments, the stabilizing end 88 is substantially planar and includes a size and shape to support the flexible bag 12 and its contents in an elevated position.

In some embodiments, a package receiving unit 96 is coupled to or integrated with the rigid receptacle 40. The package receiving unit 96 may be elevated with respect to the stabilizing end 88 and may be configured to support one or more packages 26 disposed within the flexible bag 12. In some embodiments, the package receiving unit 96 provides a structure for the flexible bag 12 to receive at least one package 26 therein.

In some embodiments, the package delivery system 42 further includes an anchor element 52 coupled to the rigid receptacle 40 and/or package receiving unit 96. In some embodiments, the anchor element 52 is configured to anchor or tether the rigid receptacle 40 and/or package receiving unit 96 to a fixed structure 54, such as a railing, a chair, a couch, a planter, a building, a bike rack, a cement block, or any other suitable fixture or fixed location. In some embodiments, the anchor element 52 anchors the rigid receptacle 40 to a stake in the ground.

Referring now to FIG. 2A while still referring to FIG. 3A, in some embodiments, the flexible bag 12 is coupled to the rigid receptacle 40 and retained in the open position 22 for package delivery. In some embodiments, the receiving end 46 includes an outer perimeter 47 configured to retain the flexible bag 12 in the open position 22. In some embodiments, the outer perimeter 47 has a rectangular, circular, square, or another suitable shape.

In some embodiments, the rigid receptacle 40 includes a package receiving unit 96 configured to receive and support the flexible bag 12 in the open position 22. The package receiving unit 96 may further be configured to receive and support the contents of the flexible bag 12, including one or more packages. In certain embodiments, the package receiving unit 96 may include acrylic, plexiglass, PVC, or any other suitable material. The package receiving unit 96 may include any open three-dimensional shape such as an open box, cylinder, or other suitable regular or irregular three-dimensional shape. In some embodiments, the package receiving unit 96 has a shape identical or substantially similar to the flexible bag 12. In other embodiments, the flexible bag 12 is configured to substantially conform to the shape of the package receiving unit 96.

In some embodiments, the top end 14 of the flexible bag 12 engages the outer perimeter 47 of the rigid receptacle 40 to retain the opening 20 of the flexible bag 12 in the open position 22. In other embodiments, as shown, the top edge 18 of the flexible bag 12 is configured to fold over the outer perimeter 47 of the rigid receptacle 40. Thus, the top edge 18 of the flexible bag 12 may be disposed below the receiving end 46 of the rigid receptacle 40 with respect to the longitudinal axis 64.

Referring now to FIGS. 3A, 4A, 4B, and 4C, and as discussed in more detail below, in certain embodiments, the exterior surface 27 of the flexible bag 12 creates an overhang 19 where the top end 14 is folded over the outer perimeter 47 of the rigid receptacle 40. The exterior surface 27 of the top end 14 of the flexible bag 12 may thus be disposed adjacent to the exterior surface of 27 of a lower portion of the flexible bag 12, with the outer perimeter 47 of the rigid receptacle 40 sandwiched therebetween. In some embodiments, friction between the exterior surface 27 of the top end 14 and the exterior surface 27 of the lower portion may stabilize the orientation of the flexible bag 12 with respect to the rigid receptacle 40 in the open position 22. In certain embodiments, the exterior surface 27 of the flexible bag 12 may include a texture or features such as knobs, projections, hook and loop fabric, and/or any other suitable features to further facilitate friction between the adjacent exterior surfaces 27 of the flexible bag 12.

Referring now to FIGS. 2A, 2B, 2C, 2D, and 2E, in operation, in some embodiments, the rigid receptacle 40 may retain the flexible bag 12 in an upright position such that a user 98 may easily access the interior area 29 of the flexible bag 12 to deliver one or more packages 26. In certain embodiments, the bottom end 16 of the flexible bag 12 may be disposed adjacent to an inside surface (not shown) of a base portion 100 of the package receiving unit 96. In some embodiments, as shown in FIG. 2A, the top edge 18 of the flexible bag 12 folds over the outer perimeter 47 of the rigid receptacle 40 and the package receiving unit 96. Thus, the outer perimeter 47 and the package receiving unit 96 may retain the opening 20 of the flexible bag 12 in the open position 22. In this manner, a user 98 may easily deliver a package 26 into the flexible bag 12.

Referring now to FIG. 2B, after delivering the package 26 into the flexible bag 12, the user 98 may actuate the security strap 48 to close the opening 20. In some embodiments, the security strap 48 is actuated by pulling the handle mechanism 30 away from the locking mechanism 28. For example, in some embodiments, the security strap 48 is actuated by pulling the handle mechanism 30 from a retracted position 32 (shown in FIG. 2A) towards an extended position 34 (shown in FIG. 2C). The handle mechanism 30 may be substantially resilient such that at least a portion of the handle mechanism 30 may bend such that it may be retained within the locking mechanism 28 when the flexible bag 12 is in the open position 22 illustrated in FIG. 2A.

As shown in FIG. 2B, pulling or otherwise extending the handle mechanism 30 may cause the top edge 18 of the flexible bag 12 to slide upwards in a vertical direction parallel to the longitudinal axis 64. In some embodiments, this movement may cause the folded top end 14 to disengage the outer perimeter 47 of the rigid receptacle 40, thereby moving the opening from the open position 22 illustrated in FIG. 2A to an intermediate position 33. Continuing to extend the handle mechanism 30 in this manner may continue to cinch the security strap 48 until the handle mechanism 30 is fully extended and the opening 20 reaches a fully closed position 24, as shown in FIG. 2C.

Referring now to FIGS. 2A, 2B, and 2C, in some embodiments, at least a portion of the flexible bag 12 remains engaged with the rigid receptacle 40 as the security strap 48 cinches the opening 20 from the open position 22 to the closed position 24. In some embodiments, the top edge 18 of the flexible bag 12 creates a lid 62 in the fully closed position 24. In certain embodiments, the opening 20 closes around the locking mechanism 28 such that the interior area 29 of the flexible bag 12 is inaccessible in the closed position 24. In some embodiments, an outer surface or perimeter of the locking mechanism 28 may be configured to selectively engage the opening 20 of flexible bag 12 to further secure the opening 20 in the closed position 24.

Figure 2D:
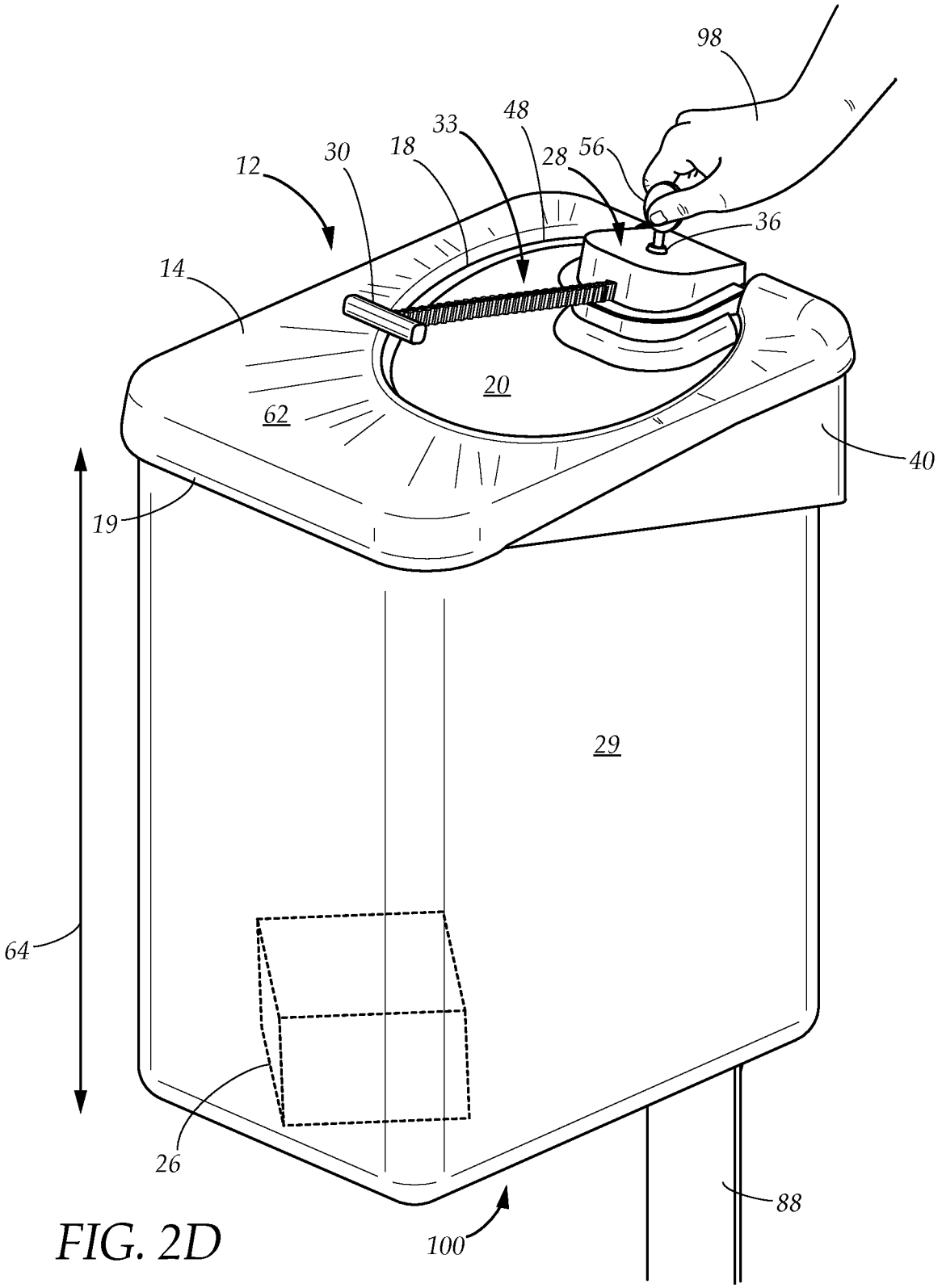
FIG. 2D is a perspective view of the package delivery apparatus of FIG. 2A being unlocked following package delivery in accordance with the disclosure.
Figure 2E:
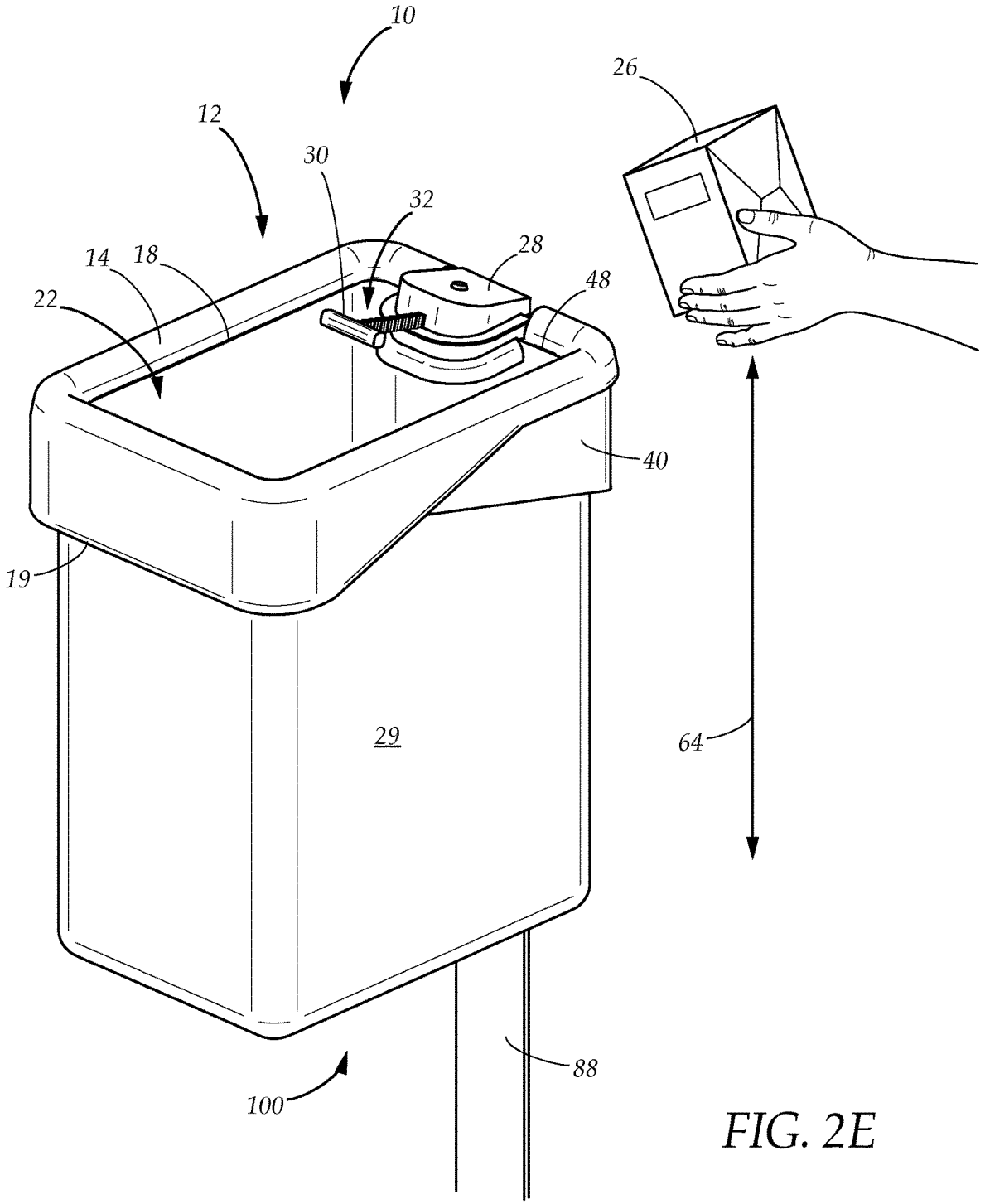
FIG. 2E is a perspective view of removal of the package from the package delivery apparatus of FIG. 2A after delivery in accordance with some embodiments.

Referring now to FIG. 2D, in some embodiments, a user 98 may unlock the locking mechanism 28 to re-open the opening 20 of the flexible bag 12 and gain access to the interior area 29. Thus, in some embodiments, the locking mechanism 28 includes a lock element 36 accessible from the outside of the flexible bag 12 when the opening 20 is in the closed position 24 shown in FIG. 2C. In certain embodiments, the owner or other authorized user 98 of the flexible bag 12 and/or its contents may possess a key element 56 configured to re-open the flexible bag 12 and enable access to its contents.

In some embodiments, the key element 56 may be configured to engage the lock element 36 to selectively unlock the security strap 48 from the closed position 24 shown in FIG. 2C. In some embodiments, the lock element 36 may be configured to unlock the security strap 48 in response to rotation of the key element 56. In certain embodiments, the lock element 36 may be configured to unlock and/or disengage the anchor element 52 shown in FIG. 3A from the rigid receptacle 40 in response to further rotation of the key element 56 or in response to rotation of the key element 56 to a certain position or orientation with respect to the lock element 36.

Unlocking the security strap 48 in this manner may release the security strap 48 from the locking mechanism 28, thereby enabling the user 98 to re-open the flexible bag 12 and access and/or remove its contents. In some embodiments, unlocking the security strap 48 may enable the user 98 to remove the flexible bag 12 from the rigid receptacle 40 and/or remove the rigid receptacle 40 from a fixed structure 54 or site, as shown in FIG. 3A.

Referring now to FIGS. 3A, 3B, and 3C, in some embodiments, an anchor element 52 is coupled to the rigid receptacle 40 and configured to anchor the rigid receptacle 40 to the fixed structure 54. In some embodiments, the anchor element 52 includes a security cable 53, chain, or other suitable device having a first end (not shown) integrated with the locking mechanism 28 and a second end 55 secured to the fixed structure 54. In some embodiments, the first end 51 is integrated with the locking mechanism 28 and extends through a hole 102 or other opening through the rigid receptacle 40. In some embodiments, the hole 102 is formed as part of the locking mechanism 28 housing 66.

In some embodiments, the security cable 53 includes steel or another durable metal, plastic, or combination thereof. The security cable 53 may be flexible or resilient. In some embodiments, the security cable 53 is cut-resistant. In some embodiments, the second end 55 of the security cable 53 includes a loop such that the security cable 53 may wrap around a fixed structure 54 and then be threaded through the second end 55 or otherwise engage its second end 55 to anchor the rigid receptacle 40 to the fixed structure 54.

Referring now to FIG. 3C, in some embodiments, the rigid receptacle 40 includes one or more securing features 60 configured to engage the exterior surface 27 of the flexible bag 12. In some embodiments, the securing feature 60 includes a hook, a channel, a loop, a ring, a hook and loop fabric, and/or any other suitable securing feature 60. At least one attachment element 58 may be coupled to the exterior surface 27 of the flexible bag 12 and configured to removably engage the securing feature 60. In some embodiments, the attachment element 58 includes a hook, a clip, a clasp, a hook and loop fabric, a snap, a rivet, and/or any other suitable attachment element 58.

In some embodiments, the first end 51 of the anchor element 52 includes a locking head 93 configured to engage an anchor retention element 90 of the rigid receptacle 40 and/or locking mechanism 28. In some embodiments, the locking head 93 is made of steel or another suitable metal, plastic, or other rigid material or combination thereof. The locking head 93 may have a size and shape configured to automatically engage a corresponding portion of the anchor retention element 90 such that a position of the anchor element 52 is locked relative to the anchor retention element 90.

For example, in certain embodiments, the anchor retention element 90 includes an aperture having a size and shape configured to receive the locking head 93 therethrough. The locking head 93, however, may have an hourglass configuration such that locking head 93 widens in a direction from an end 95 to a midpoint 97, narrows at the midpoint 97, and widens again thereafter. In this manner, the anchor retention element 90 may permit introduction of the end 95 of the locking head 93 but may lock around the locking head 93 at its midpoint 97, thereby preventing disengagement of the locking head 93 from the anchor retention element 90 in any direction.

In certain embodiments, the locking mechanism 28 is configured to selectively release the first end 51 or locking head 93 of the anchor element 52 from the locking mechanism 28 of the rigid receptacle 40 in response to actuation of the locking mechanism 28, as discussed in more detail below.

Referring now to FIGS. 4A, 4B, 4C and 6, in some embodiments, a package delivery apparatus 10 for securing delivered packages includes a flexible bag 12 configured to accommodate one or more packages (not shown), a security strap 48, and a locking mechanism 28. In some embodiments, the flexible bag 12 includes an interior area 29, an exterior surface 27, and a top edge 18 forming an opening 20. The opening 20 may be adjustable between an open position 22 providing access to the interior area 29 and a closed position 24 preventing access thereto. In some embodiments, the locking mechanism 28 includes a handle mechanism 30 to facilitate cinching the security strap 48 between the open position 22 and the closed position 24.

The security strap 48 may be integrated with the flexible bag 12 and configured to cinch around the opening 20 to move the opening 20 to the closed position 24. In some embodiments, as discussed in more detail below, the locking mechanism 28 moves the security strap 48 in exactly one direction to automatically secure the closed position 24.

Referring now to FIGS. 6, 7, 8A-C, and 9A-C, in some embodiments, the locking mechanism 28 is coupled to the flexible bag 12 and configured to move the security strap 48 in exactly one direction to secure a position of the opening 20. In some embodiments, the locking mechanism 28 is coupled to a portion of the outer perimeter 47 of the rigid receptacle 40 such that it corresponds to one side of the flexible bag 12 (not shown) and/or package receiving unit 96. The locking mechanism 28 may include a housing 66 having various components integrated therewith and/or welded or otherwise securely coupled thereto. For example, in some embodiments, the locking mechanism 28 may include a lock element 36, a ratcheting mechanism 44, and a handle mechanism 30.

In some embodiments, the housing 66 is made of acrylonitrile butadiene styrene ("ABS"), polycarbonate ("PC"), polyphenylene oxide ("PPO"), polyphenylene ether ("PPE"), polyamide ("PA"), polybutylene terephthalate ("PBT"), acrylic, or any other suitable rigid plastic and/or other suitable material. In some embodiments, the housing 66 includes an interior surface 68, an exterior surface 70, and at least one slot 72 extending therethrough. The slot 72 may be configured to align the security strap 48 with the outer perimeter 47 of the rigid receptacle 40 and to receive at least a portion of the security strap 48 therethrough. In some embodiments, a first slot 72*a* is integrated into a first sidewall 76*a* of the housing 66 and a second slot 72*b* is integrated into a second sidewall 76*b* of the housing 66 such that the first slot 72*a* is disposed opposite the second slot 72*b*.

The lock element 36 may include a lock cylinder made of steel, titanium, or other suitable metal. In some embodiments, the lock element 36 is coupled to or otherwise accessible on the exterior surface 27 of the housing 66. The lock element 36 may include a cam lock configured to rotate within the housing 66 to selectively release a position of the security strap 48 and/or the anchor element 52.

In some embodiments, the ratcheting mechanism 44 is fixed to the interior surface 68 of the housing 66 and configured to receive the security strap 48 therethrough. The ratcheting mechanism 44 may be configured to automatically lock the position of the security strap 48 in response to the security strap 48 being pulled or extended therethrough in exactly one direction.

Figure 8A:
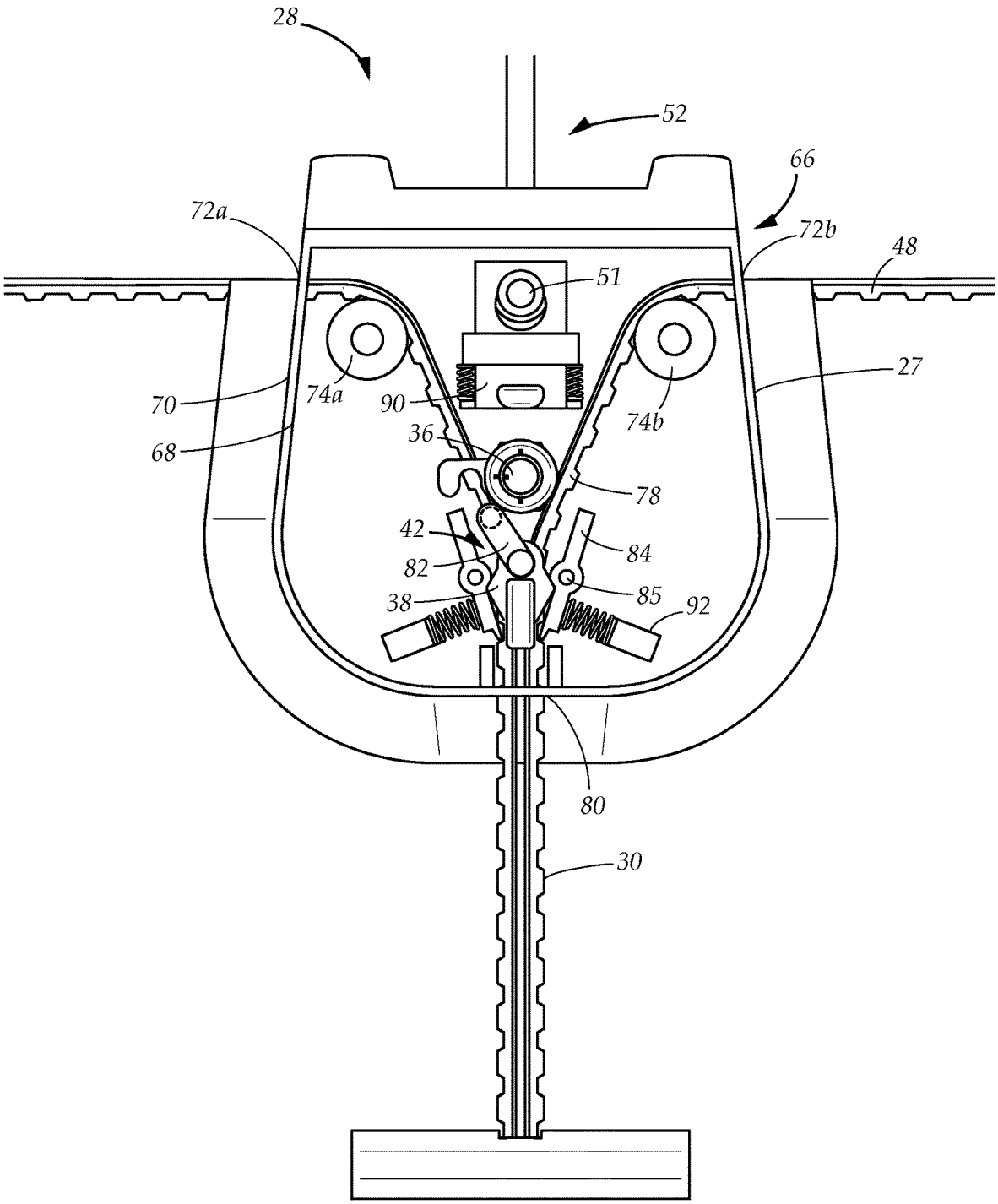
FIG. 8A is a top view of one embodiment of a locking mechanism showing the lock element in a locked position in accordance with certain embodiments.

For example, as shown in FIG. 8A, in one embodiment, a portion of the security strap 48 is attached to the handle mechanism 30. In some embodiments, the handle mechanism 30 is coupled to a portion of the security strap 48 within the housing 66 such that the handle mechanism 30 extends outwardly from the housing 66 and is accessible on an exterior surface 27 of the housing 66. The handle mechanism 30 may be movable from a retracted position 32 shown in FIG. 2A to an extended position 34 shown in FIG. 2C to cinch the security strap 48 and thereby cinch the opening 20 (not shown). In certain embodiments, as illustrated in FIG. 2B, the handle mechanism 30 is pulled outwardly toward the opening 20 of the flexible bag 12 to move the security strap 48 through the ratcheting mechanism 44 (shown in FIG. 7) in a single direction to automatically lock the security strap 48 into position.

Referring now to FIGS. 7, 8A-C, and 9A-C, in some embodiments, the locking mechanism 28 includes one or more guide elements 74 coupled to the interior surface 68 of the housing 66. Each guide element 74 may include a substantially elongate post having a cylindrical, circular, rectangular, triangular, or other suitable three-dimensional shape. In some embodiments, the guide elements 74 may be disposed proximate to each of the slots 72*a*, 72*b* to guide the security strap 48 from the slot 72 and towards or into the ratcheting mechanism 44.

As previously mentioned, in some embodiments, the housing 66 includes a first sidewall 76*a* having a first slot 72*a* and a second sidewall 76*b* having a second slot 72*b*. The security strap 48 may extend through the first slot 72*a* and the second slot 72*b* to form a closed loop 78 within the housing 66. In some embodiments, the handle mechanism 30 is coupled to the portion of the security strap 48 forming the closed loop 78 within the housing 66. In certain embodiments, the handle mechanism 30 may move the security strap 48 through the first and second slots 72, 72*b* simultaneously in response to the handle mechanism 30 moving from the retracted position 32 of FIG. 2A towards the extended position 34 of FIG. 2C. In certain embodiments, the housing 66 includes an aperture 80 to receive at least a portion of the handle mechanism 30 therethrough.

Figure 8B:
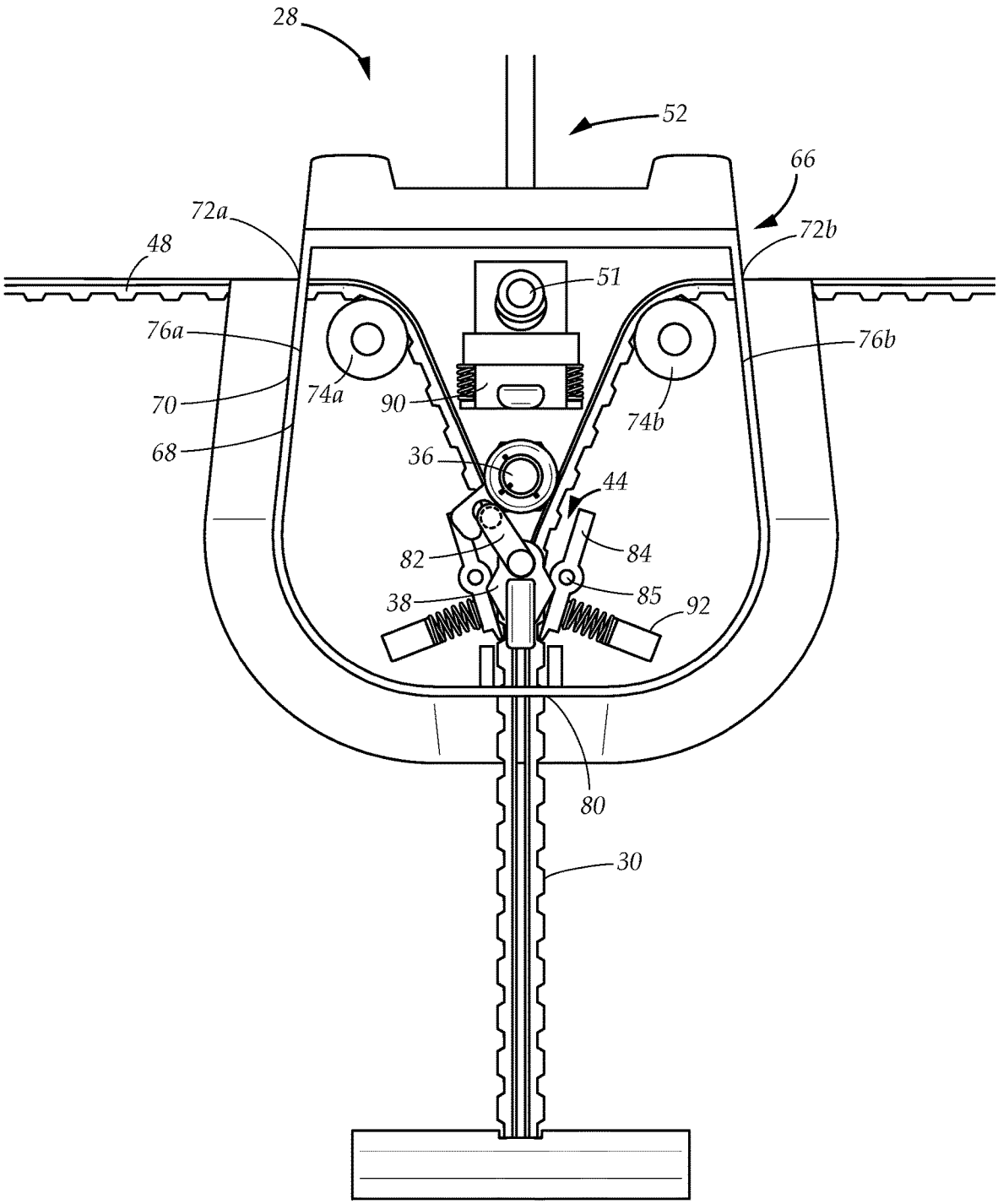
FIG. 8B is a top view of the locking mechanism of FIG. 8A showing the lock element engaged with the release mechanism in accordance with certain embodiments.

Referring now to FIG. 3B, while still referring to FIGS. 7, 8A-C, and 9A-C, in some embodiments, the package delivery apparatus 10 includes a key element 56 configured to engage the lock element 36 to selectively release a position of the security strap 48. In some embodiments, the key element 56 may be rotated within the lock element 36 to actuate a release mechanism 38. The release mechanism 38 may be coupled to the interior surface 68 of the housing 66 and configured to disengage the closed loop 78 portion of the security strap 48 from the ratcheting mechanism 44. In certain embodiments, as shown in FIG. 8B, a linkage element 82 is coupled to the ratcheting mechanism 44. The key element 56 may be configured to selectively engage the linkage element 82 to actuate the release mechanism 38.

Figure 8C:
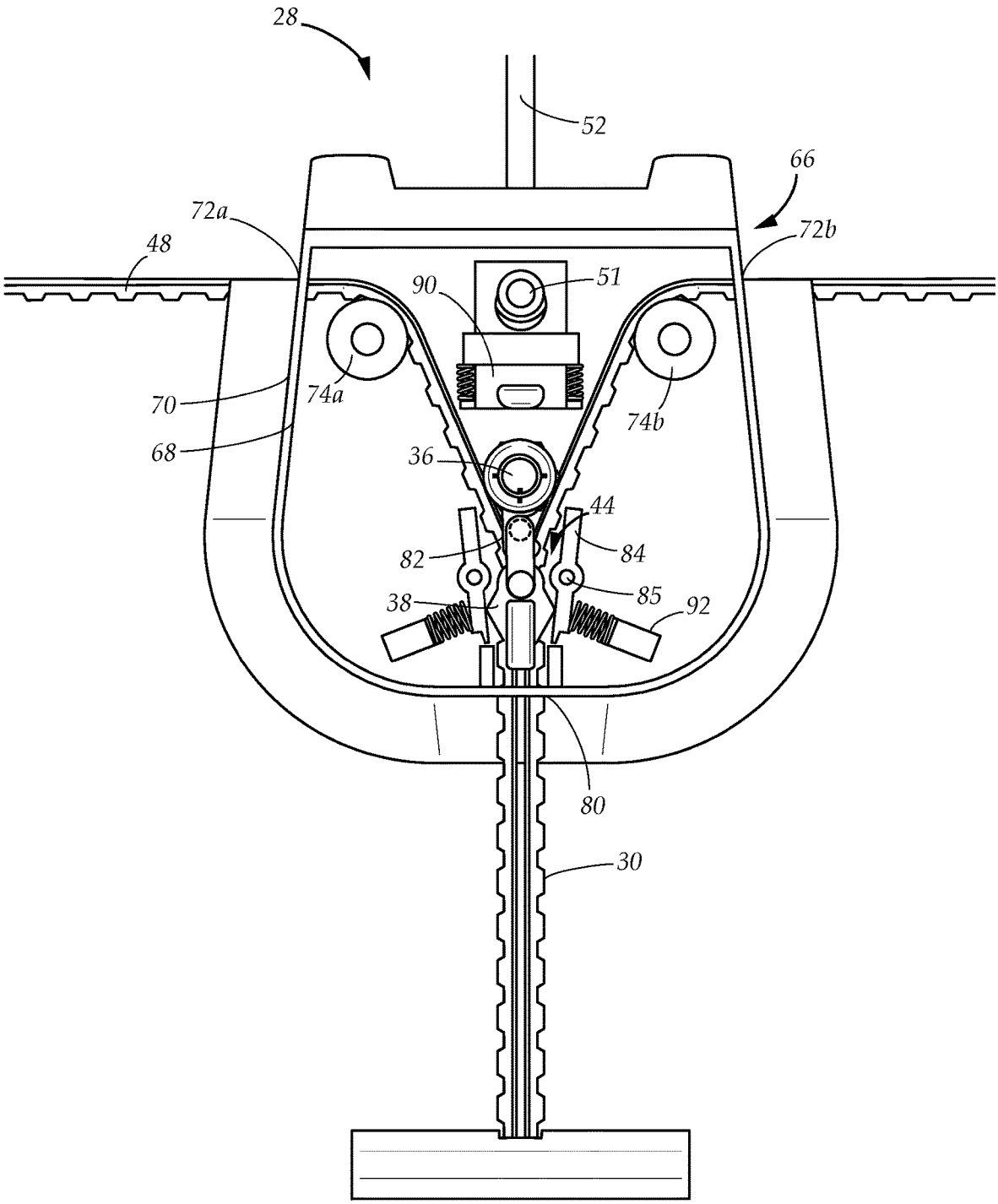
FIG. 8C is a top view of the locking mechanism of FIG. 8A showing actuation of the release mechanism in accordance with certain embodiments.
Figure 9A:
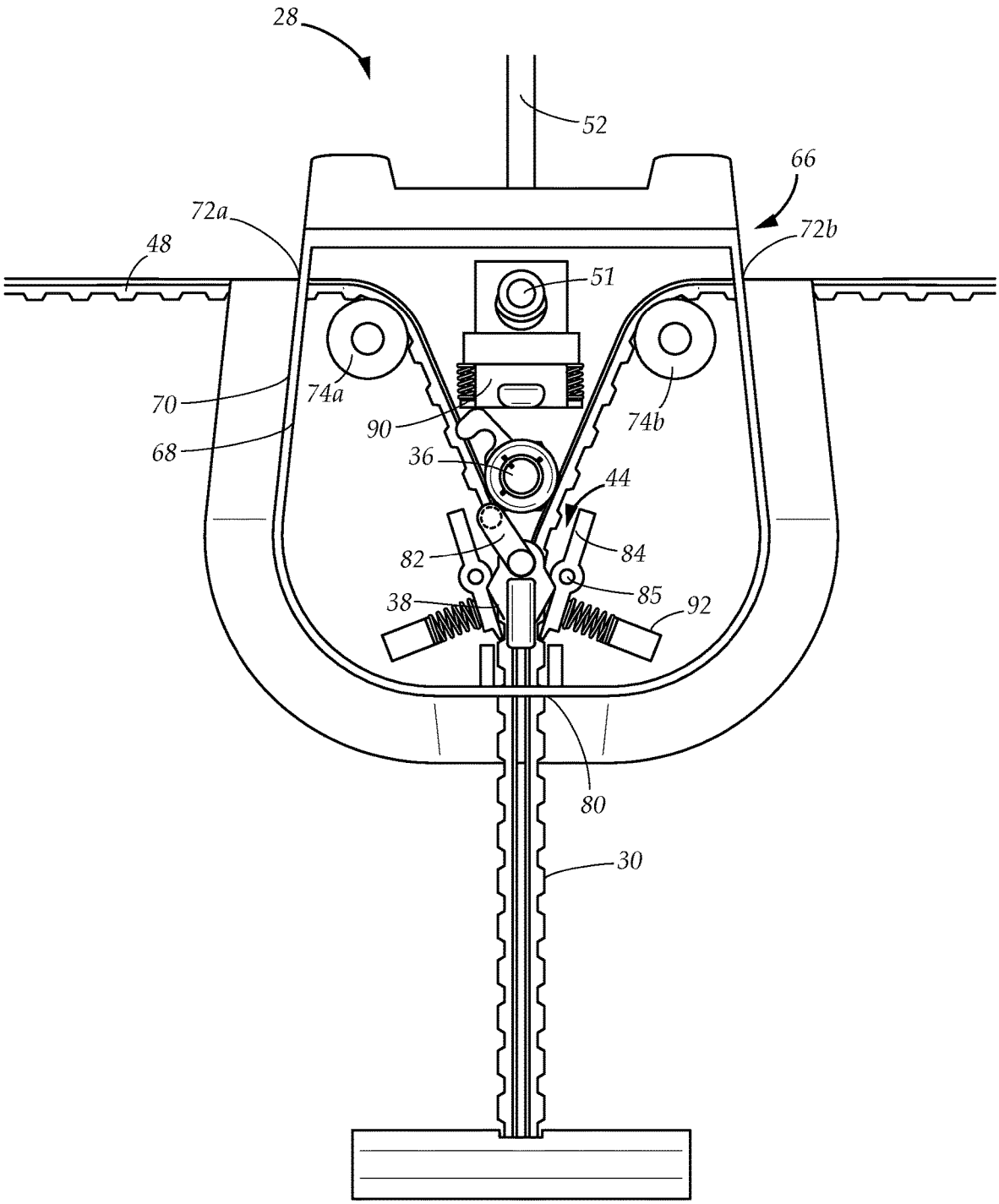
FIG. 9A is a top view of one embodiment of a locking mechanism showing the lock element rotated toward the anchor release mechanism in accordance with some embodiments.
Figure 9B:
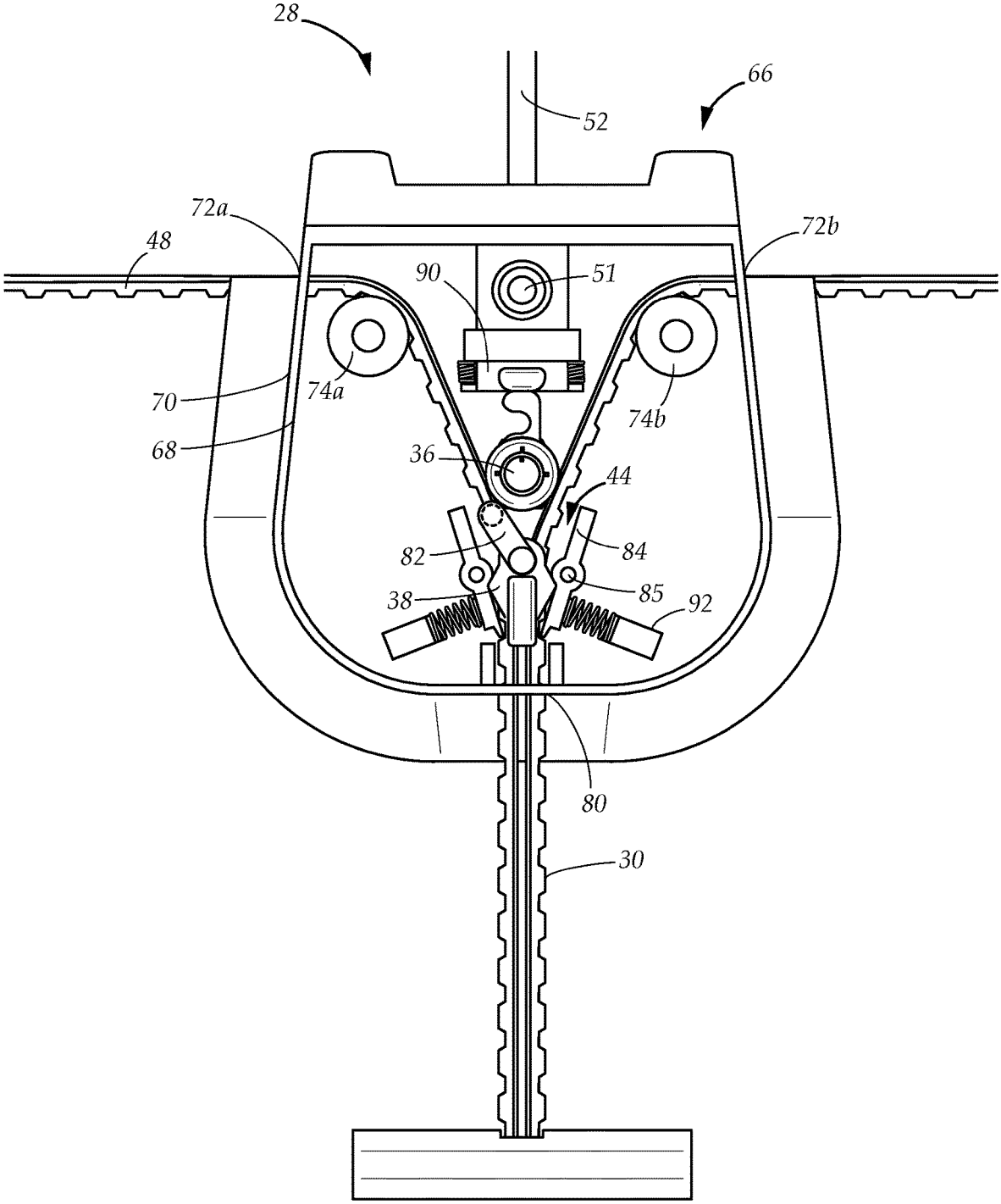
FIG. 9B is a top view of the locking mechanism of FIG. 9A showing the lock element engaged with the anchor release mechanism in accordance with some embodiments.
Figure 9C:
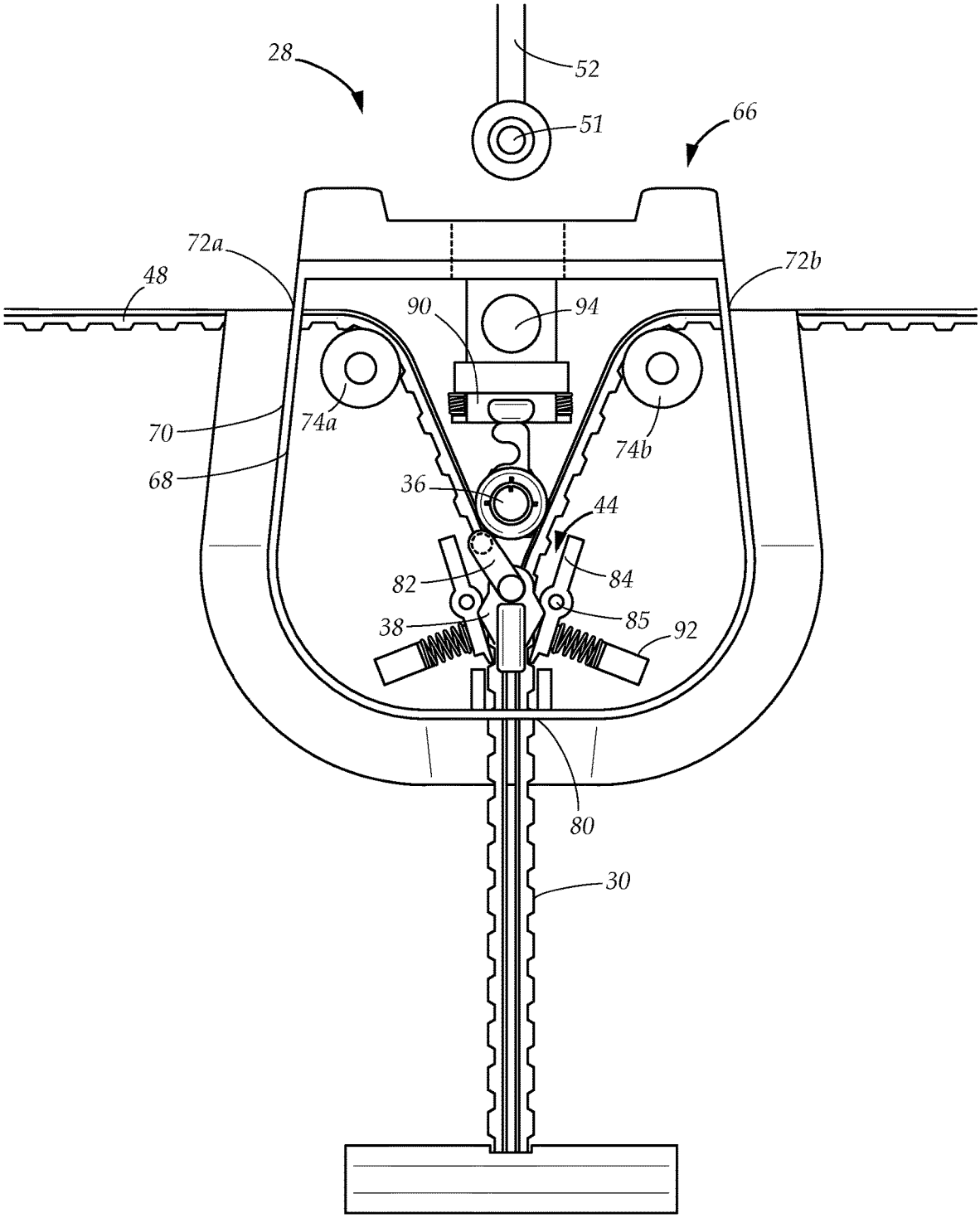
FIG. 9C is a top view of the locking mechanism of FIG. 9A showing the anchor element released from the locking mechanism in accordance with some embodiments.

In some embodiments, as shown in FIG. 8C, the ratcheting mechanism 44 includes at least one pawl 84 configured to rotate about a pin 85. The pawl 84 may have a shape configured to secure a position of the ratcheting mechanism 44 relative to the housing 66, thereby ensuring that the security strap 48 moves in a single direction relative to the ratcheting mechanism 44. In some embodiments, a spring 92 biases the pawl 84 against the ratcheting mechanism 44. In some embodiments, the pawl 84 is configured to engage the security strap 48. In other embodiments, the ratcheting mechanism 44 includes a pulley (not shown) and the pawl 84 is configured to engage the pulley (not shown). In these and other embodiments, the pawl 84 thereby ensures contact between the security strap 48 and the ratcheting mechanism 44. The force of the spring 92 against the pawl 84 may also lock the position of the security strap 48 with respect to the ratcheting mechanism 44.

In some embodiments, a release mechanism 38 may be coupled to or integrated with the ratcheting mechanism 44. In these and other embodiments, the release mechanism 38 is configured to move the ratcheting mechanism 44 relative to the housing 66. The ratcheting mechanism 44 may thus exert a counterforce against the pawl 84, causing the pawl 84 to rotate about the pin 85 in a direction away from the ratcheting mechanism 44. In some embodiments, this rotation may cause the ratcheting mechanism 44 to disengage the security strap 48. As a result, referring now to FIGS. 2A, 2C, and 2D, while still referring to FIG. 8C, in some embodiments, the security strap 48 is loosened relative to the ratcheting mechanism 44 and the dimensions of the opening 20 may increase from the closed position 24 to the open position 22. In some embodiments, the release mechanism 38 is configured to release the security strap 48 in response to engaging the key element 56 with respect to the lock element 36 and rotating the key element 56 with respect thereto.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a package delivery apparatus and system for securing delivered packages. The disclosure is illustrated by example in the drawing figures, and throughout the written description. It should be understood that numerous variations are possible, while adhering to the inventive concept. Such variations are contemplated as being a part of the present disclosure.

What is claimed is:

1. A package delivery apparatus for securing delivered packages, comprising:

a flexible bag comprising an interior area, an exterior surface, and a top edge forming an opening, wherein the opening is adjustable between an open position providing access to the interior area and a closed position preventing access to the interior area, wherein the interior area is configured to accommodate at least one package;

a security strap integrated with the flexible bag and configured to cinch around the opening to move the opening to the closed position;

a locking mechanism coupled to the flexible bag and configured to selectively allow the security strap to move in one direction to secure the opening in the closed position, wherein the locking mechanism comprises:

a housing having an interior surface, an exterior surface, and at least one slot extending therethrough, wherein the slot is configured to receive at least a portion of the security strap, a lock element configured to selectively release a position of the security strap, a ratcheting mechanism fixed to the interior surface and configured to selectively engage the portion of the security strap to only allow the security strap to move in the one direction, and a handle mechanism coupled to the portion of the security strap and extending from the housing, wherein the handle mechanism is movable from a retracted position to an extended position to cinch the security strap and thereby move the opening to the closed position; and an anchor element coupled to the locking mechanism, wherein the anchor element is configured to selectively anchor the housing to a fixed structure.

2. The package delivery apparatus of claim 1, wherein the locking mechanism comprises at least one guide element coupled to the interior surface of the housing to guide the portion of the security strap through the at least one slot and into the ratcheting mechanism.

3. The package delivery apparatus of claim 1, wherein the housing comprises a first sidewall having a first slot and a second sidewall having a second slot, wherein the security strap extends through each of the first slot and the second slot to form a closed loop within the housing.

4. The package delivery apparatus of claim 3, wherein the handle mechanism is coupled to the closed loop such that moving the handle mechanism to the extended position moves the security strap through each of the first slot and the second slot simultaneously.

5. The package delivery apparatus of claim 4, wherein the housing comprises an aperture configured to receive the handle mechanism therethrough.

6. The package delivery apparatus of claim 1, further comprising a key element configured to engage the lock element to selectively actuate a release mechanism, wherein the release mechanism is coupled to the interior surface of the housing and configured to selectively disengage the portion of the security strap from the ratcheting mechanism and release the anchor element from the locking mechanism.

7. The package delivery apparatus of claim 6, further comprising a linkage element coupled to the ratcheting mechanism, wherein the key element is configured to selectively engage the linkage element to actuate the release mechanism.

8. The package delivery apparatus of claim 6, wherein the ratcheting mechanism comprises at least one pawl and the release mechanism is configured to rotate the at least one pawl to release the security strap.

9. The package delivery apparatus of claim 1, wherein the security strap comprises one of a ratcheting cable, a perforated belt, and a toothed belt, wherein the ratcheting mechanism comprises at least one pawl configured to engage the security strap.

10. The package delivery apparatus of claim 1, wherein the ratcheting mechanism comprises a pulley configured to engage at least one pawl to secure a position of the security strap.

11. A package delivery system for securing delivered packages, comprising:

a flexible bag comprising an interior area, an exterior surface, a top end, a bottom end, and a top edge forming an opening, wherein the opening is adjustable between an open position providing access to the interior area and a closed position preventing access to the interior area, wherein the interior area is configured to accommodate at least one package;

a security strap integrated with the top end of the flexible bag and configured to cinch around the opening to move the opening to the closed position;

a rigid receptacle having a receiving end having an outer perimeter, and a package receiving unit that is a three dimensional shape extending downwardly from the receiving end and open at the receiving end, wherein the package receiving unit is configured to removably retain the flexible bag such that the flexible bag extends downwardly into the package receiving unit; and a locking mechanism coupled to the receiving end and configured to selectively allow the security strap to move in one direction to secure the opening in the closed position, wherein the locking mechanism comprises:

a housing having an interior surface, an exterior surface, and a slot extending therethrough, wherein the slot is configured to receive at least a portion of the security strap;

a lock element configured to selectively release a position of the security strap;

a ratcheting mechanism fixed to the interior surface and configured to selectively engage the portion of the security strap to only allow the security strap to move in the one direction; and a handle mechanism coupled to the portion of the security strap and extending from the housing, wherein the handle mechanism is movable from a retracted position to an extended position to cinch the security strap and thereby move the opening to the closed position.

12. The package delivery system of claim 11, wherein the housing comprises a first sidewall having a first slot and a second sidewall having a second slot, wherein the security strap extends through each of the first slot and the second slot to form a closed loop within the housing, wherein the handle mechanism is coupled to the closed loop such that moving the handle mechanism to the extended position moves the security strap through each of the first slot and the second slot simultaneously.

13. The package delivery system of claim 12, further comprising an anchor element coupled to the rigid receptacle, wherein the anchor element is configured to anchor the rigid receptacle to a fixed structure wherein the anchor element comprises a cable having a first end integrated with the locking mechanism and a second end secured to the fixed structure.

14. The package delivery system of claim 13, wherein the locking mechanism is configured to selectively release the anchor element from the rigid receptacle.

15. The package delivery system of claim 11, wherein the top edge of the flexible bag is configured to fold over the outer perimeter to engage the rigid receptacle when the opening is in the open position, wherein the top edge is disposed below the receiving end in the open position.

16. The package delivery system of claim 15, wherein the top edge of the flexible bag is configured to move upward in a direction parallel to the longitudinal axis to disengage the top edge from the rigid receptacle and create a lid when the handle mechanism is moved towards the extended position.

17. The package delivery system of claim 11, wherein the rigid receptacle comprises at least one securing feature configured to engage the exterior surface of the flexible bag.

18. The package delivery system of claim 17, further comprising at least one attachment element coupled to the exterior surface of the flexible bag and configured to engage the at least one securing feature.

19. The package delivery system of claim 11, further comprising a key element configured to engage the lock element to selectively actuate a release mechanism, wherein the release mechanism is coupled to the interior surface of the housing and configured to selectively disengage the security strap from the ratcheting mechanism.

20. The package delivery system of claim 19, wherein the release mechanism is further configured to release the anchor element from the rigid receptacle.

* * * * *